US007503134B2

(12) United States Patent
Buckner

(10) Patent No.: US 7,503,134 B2
(45) Date of Patent: Mar. 17, 2009

(54) INCLINED SLOPE VACUUM EXCAVATION CONTAINER

(76) Inventor: Lynn A. Buckner, P.O. Box 609, Chickamauga, GA (US) 30707

( * ) Notice: Subject to any disclaimer, the term of this patent is extended or adjusted under 35 U.S.C. 154(b) by 634 days.

(21) Appl. No.: 10/810,184

(22) Filed: Mar. 29, 2004

(65) Prior Publication Data

US 2005/0210623 A1 Sep. 29, 2005

Related U.S. Application Data

(63) Continuation-in-part of application No. 10/217,055, filed on Aug. 12, 2002, now Pat. No. 6,988,568, which is a continuation-in-part of application No. 09/722,797, filed on Nov. 27, 2000, now Pat. No. 6,453,584.

(60) Provisional application No. 60/384,719, filed on Jun. 3, 2002, provisional application No. 60/363,058, filed on Mar. 11, 2002.

(51) Int. Cl.
*E02F 3/88* (2006.01)
*B63C 7/22* (2006.01)

(52) U.S. Cl. ..... 37/317; 37/320; 175/66; 175/67; 15/352; 15/346; 15/300.1

(58) Field of Classification Search ..... 37/905, 37/304, 466, 317, 320; 15/300.1, 312.2, 15/352, 321, 330, 340.1, 345, 346; 175/67, 175/66, 42; 299/17
See application file for complete search history.

(56) References Cited

U.S. PATENT DOCUMENTS 3,512,206 A * 5/1970 Young ..... 15/346
3,755,851 A * 9/1973 Williams ..... 15/346
4,574,420 A * 3/1986 Dupre ..... 15/331
4,935,984 A * 6/1990 Bryant et al. ..... 15/302
5,016,717 A * 5/1991 Simons et al. ..... 175/66
5,200,033 A * 4/1993 Weitzman ..... 159/47.1
5,295,317 A * 3/1994 Perrott ..... 37/348
5,408,766 A * 4/1995 Pobihushchy ..... 37/323
5,425,188 A * 6/1995 Rinker ..... 37/317
5,722,113 A * 3/1998 Baziuk ..... 15/352
5,778,648 A * 7/1998 Parkes et al. ..... 56/202
6,202,330 B1 * 3/2001 Bolton ..... 37/403
6,453,584 B1 * 9/2002 Buckner ..... 37/323
6,470,605 B1 * 10/2002 Gilman et al. ..... 37/323
6,604,304 B1 * 8/2003 Slabach et al. ..... 37/304
6,615,849 B1 * 9/2003 Gilman et al. ..... 134/22.18
6,857,837 B2 * 2/2005 Rajewski ..... 414/23
7,191,485 B1 * 3/2007 Ramer ..... 15/34
2004/0194354 A1 * 10/2004 Haughen et al. ..... 37/317
2005/0076965 A1 * 4/2005 Buckner et al. ..... 137/899.4
2006/0032012 A1 * 2/2006 Buckner ..... 15/315
2006/0032095 A1 * 2/2006 Buckner ..... 37/304

FOREIGN PATENT DOCUMENTS

JP 58-222225 * 12/1983 ..... 37/905

* cited by examiner

*Primary Examiner*—Thomas A Beach

(57) ABSTRACT

A vacuum container mounted on an inclined slope and having a liquid water storage container mounted beneath the incline of the vacuum container. The water storage container may support the vacuum container. The slope may be of sufficient angle to allow debris to be emptied from the vacuum container by gravity when the access door is opened. A filter housing may be mounted to and supported by the vacuum container. By flush mounting the clean out end of the filter housing with the clean out end of the vacuum container, a single access clean out door may be used to access both simultaneously.

11 Claims, 28 Drawing Sheets

SKID STEER HYDRO-VAC

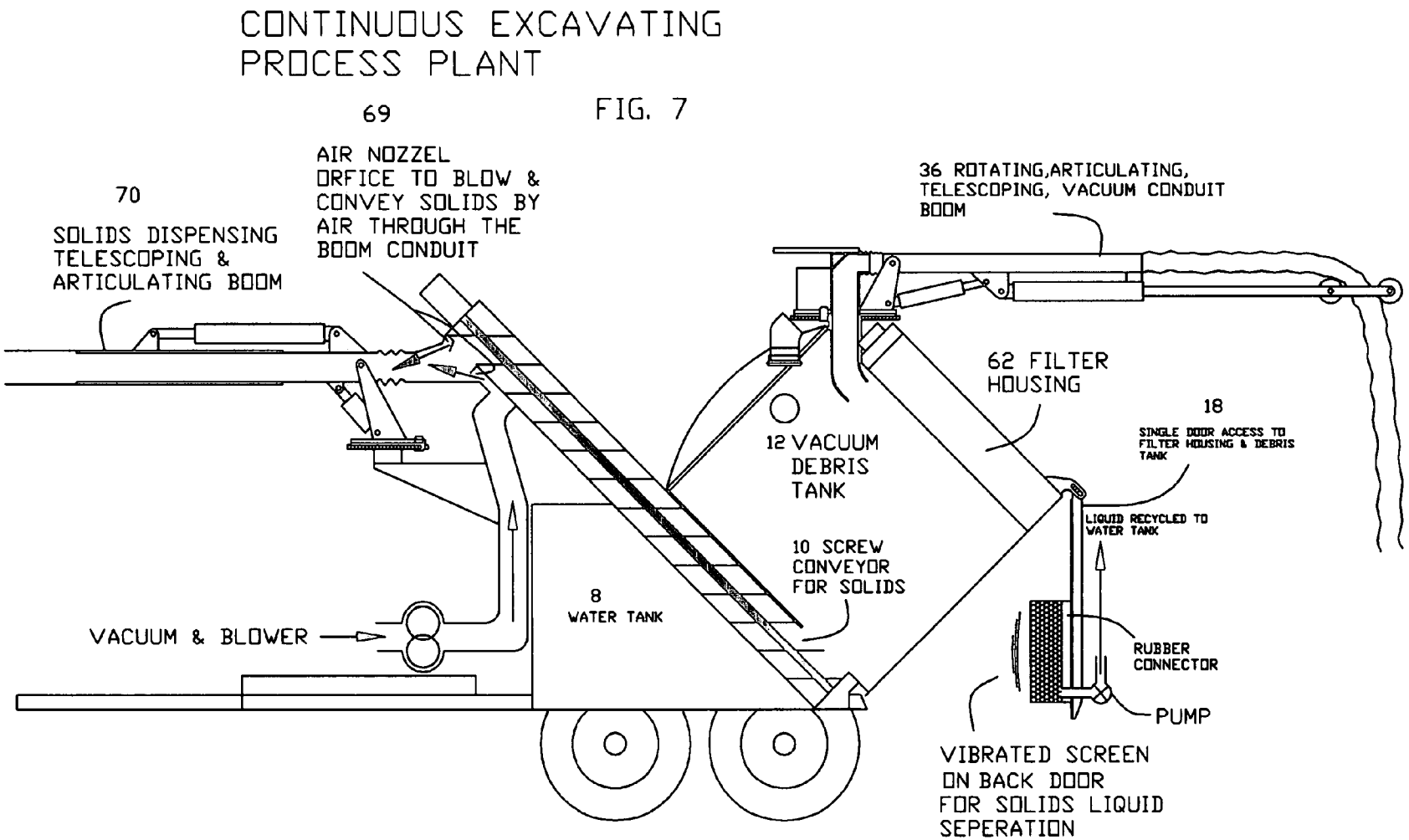
CONTINUOUS EXCAVATING
PROCESS PLANT
FIG. 7
69
70
SOLIDS DISPENSING
TELESCOPING &
ARTICULATING BOOM
AIR NOZZEL
ORFICE TO BLOW &
CONVEY SOLIDS BY
AIR THROUGH THE
BOOM CONDUIT
36 ROTATING,ARTICULATING,
TELESCOPING, VACUUM CONDUIT
BOOM
62 FILTER
HOUSING
18
SINGLE DOOR ACCESS TO
FILTER HOUSING & DEBRIS
TANK
LIQUID RECYCLED TO
WATER TANK
RUBBER
CONNECTOR
PUMP
VIBRATED SCREEN
ON BACK DOOR
FOR SOLIDS LIQUID
SEPERATION
12 VACUUM
DEBRIS
TANK
10 SCREW
CONVEYOR
FOR SOLIDS
8
WATER TANK
VACUUM & BLOWER

MAN HOLE COVER REMOVER

ROTATING HEAD SPRAYER

PLAN VIEW

SIDE X SECTION

SOUND REDUCTION MUFFLER
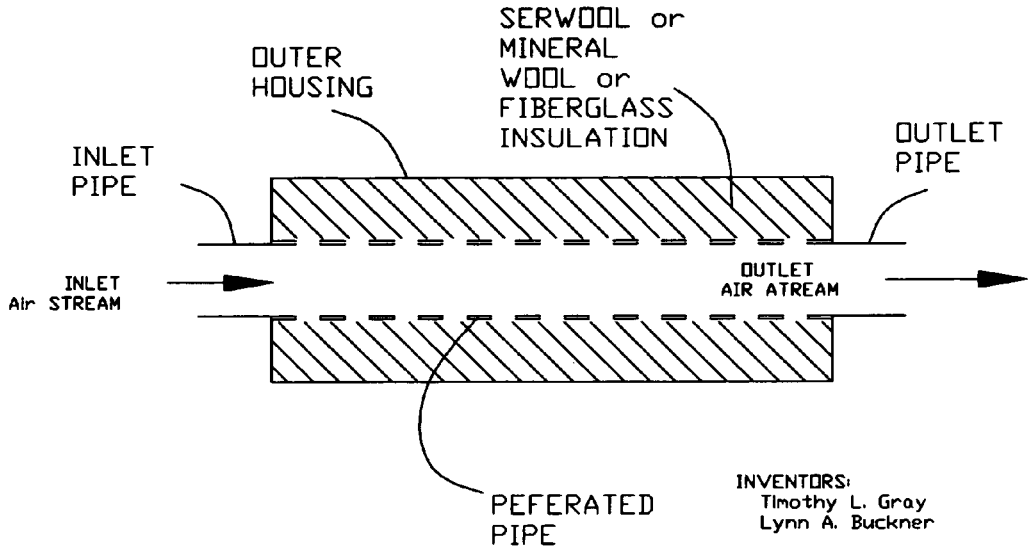
Fig. 27 A
Fig. 27 B
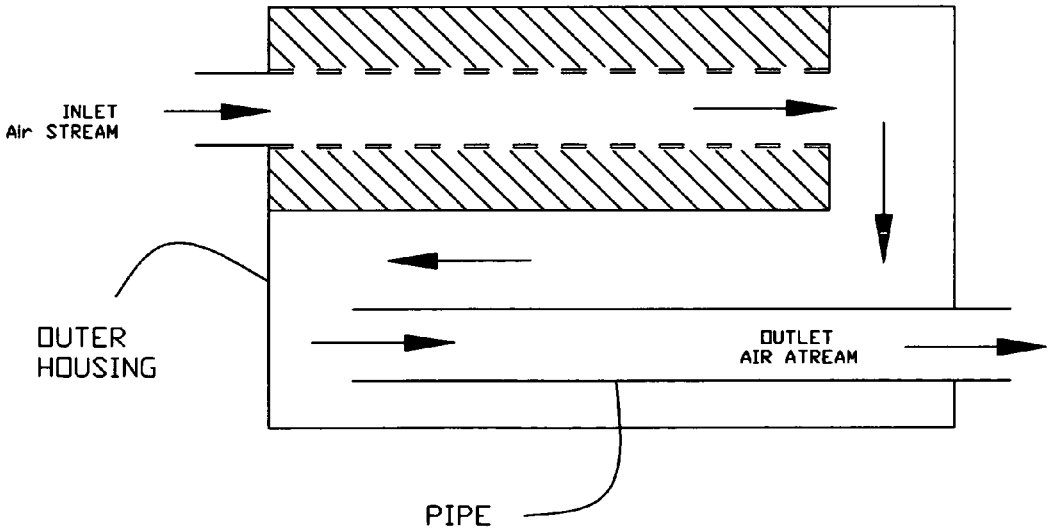

INCLINED SLOPE VACUUM EXCAVATION CONTAINER

This application is a CIP of Ser. No. 10/217,055, filed Aug. 12, 2002, now U.S. Pat. No. 6,988,568, which is a CIP of Ser. No. 09/722,797, filed Nov. 27, 2000, now U.S. Pat. No. 6,453,584, which claims benefit of Ser. No. 60/363,058 filed Mar. 11, 2002 and claims benefit of Ser. No. 60/384,719 filed Jun. 3, 2002.

FIELD OF THE INVENTION

The present invention relates to a vacuum boring and mud recovery container.

BACKGROUND OF THE INVENTION

Current state of the art vacuum boring and mud recovery systems, such as U.S. Pat. No. 6,453,584 by the present inventor, have a vacuum container having a vacuum capable of boring and mud recovery and provide simultaneously, vacuum fill, store and dispense. However problems arise from the horizontally mounted debris tank when trying to dispose of the debris.

The primary objective of the present invention is to provide a vacuum boring and mud recovery container having a fixed slope to allow a greater percentage of fill of the debris tank before the debris full level reaches the vacuum cut off valve, provides compact size, concentrated weight, efficient plumbing and debris to be emptied from the vacuum container by gravity when the access door is opened.

SUMMARY OF THE INVENTION

The above described objectives and others are met by a vacuum container mounted at a fixed slope and supported by a liquid water container. The fixed slope may be of sufficient angle to allow debris to be emptied from the vacuum container by gravity when the access door is opened. A filter housing may be mounted to and supported by the vacuum container. By flush mounting the clean out end of the filter housing. with the clean out end of the vacuum container, a single access clean out door may be used to access both simultaneously. This compact design provides efficient interaction and plumbing between the water tank, vacuum tank and filter housing as well as concentrating weight and reducing floor space. Two parallel tubular support means may be added at the base of the above described unit and extended past the water container sufficient length to mount a support base for a power plant, which may consist of an engine, a vacuum producing means, a vacuum/blower, a water pump, a water jetter pump, a hydraulic pump and reservoir, an air compressor and air tank, an electric generator, a heater, controls, monitor, sensors, or a goose neck trailer coupler.

The above described unit may be efficiently and quickly convertible from a skid mount unit to a pick-up truck bed mounted unit secured by the goose neck ball located in the bed of a pick-up truck, converted to a forklift mounted unit or a skid steer mounted unit or be converted to a trailer mounted unit dependent on the users need for the days activity. A vibrating screen may be mounted by flexible connections on the inside of the vacuum container, preferably to the inside of the access door, to separate liquids from solids.

Liquid cleaning, purification or sterilizing means may be added within the vacuum container or be mounted to the exterior of the vacuum container for the purpose of pretreatment of the water as it is recycled. A liquid dispensed means, such as a pump, may dispense liquid from the vacuum container vibrating screen effluent through the desired pretreatment means and into the liquid holding container with or without eliminating the vacuum within the vacuum container, thus recycling liquid for reuse. This technique allows the original liquid carried to a work site to be reused multiple times.

The vacuum container may have a screw conveyor means attached so as to dispense solids from the vacuum container with or without eliminating the vacuum within the vacuum container. An air nozzle means may be attached to the discharge orifice of the screw conveyor so as to further convey the solids by air. The air discharge from the vacuum-producing device may be utilized as the source of air supplied to the air nozzles for the purpose of conveying the solids dispensed by the screw conveyor. The air blower technique further improves efficiency and provides a compact system by using a single air blower device to provide both a vacuum for the vacuum container and an air volume under pressure to convey the dispensed solids.

A powered rotating, telescoping articulated boom with one or more arms, elbows and knuckles may be attached so as to convey through the boom conduit the air conveyed solids to a dispensing point of choice such as a dump truck bed or recycled back into a ditch or hole from which it was removed. A cyclone may be attached to the end of the boom conduit to separate the solids from the air volume used to convey the solids.

The above described system may be stationary or mobile. Mobility may be obtained by mounting the system on a trailer, powered vehicle, truck, zero turn radius drivable vehicle, fork lift, skid steer, barge, or railcar.

The above vacuum system is further empowered by vacuum hose end attachments, which may be applied so as to improve the vacuum ability of substances such as dirt, gravel, asphalt, concrete, or surface cleaning such as hydrocarbons, rust, or paint. The above vacuum system processes wet and/or dry material, thus providing means to separate rust, paint chips, sand, dirt, or asphalt from liquids, and further remove hydrocarbons from water and sterilize the cleaned water if needed. The high pressure water pumps provide water to a wide variety of spray nozzles at a variety of pressures for cleaning, cutting, emulsifying or demolition.

Numerous other embodiments are also possible. These elements of the embodiments described herein can also be combined in other ways, or with other elements to create still further embodiments.

BRIEF DESCRIPTION OF DRAWINGS

While the specification concludes with claims particularly pointing out and distinctly claiming the subject matter which may be regarded as forming the present invention, it is believed that the invention will be better understood from the following description taken in conjunction with the accompanying drawings, in which:

FIG. 7 is a side view of the vacuum container unit of FIG. 1, showing the solids dispensing unit according to an embodiment of the invention.

FIG. 27*a* is a side view of a sound reduction muffler according to an embodiment of the invention.

FIG. 27*b* is a side view of a sound reduction muffler according to an embodiment of the invention.

DETAILED DESCRIPTION OF THE PREFERRED EMBODIMENT

Figure 1:
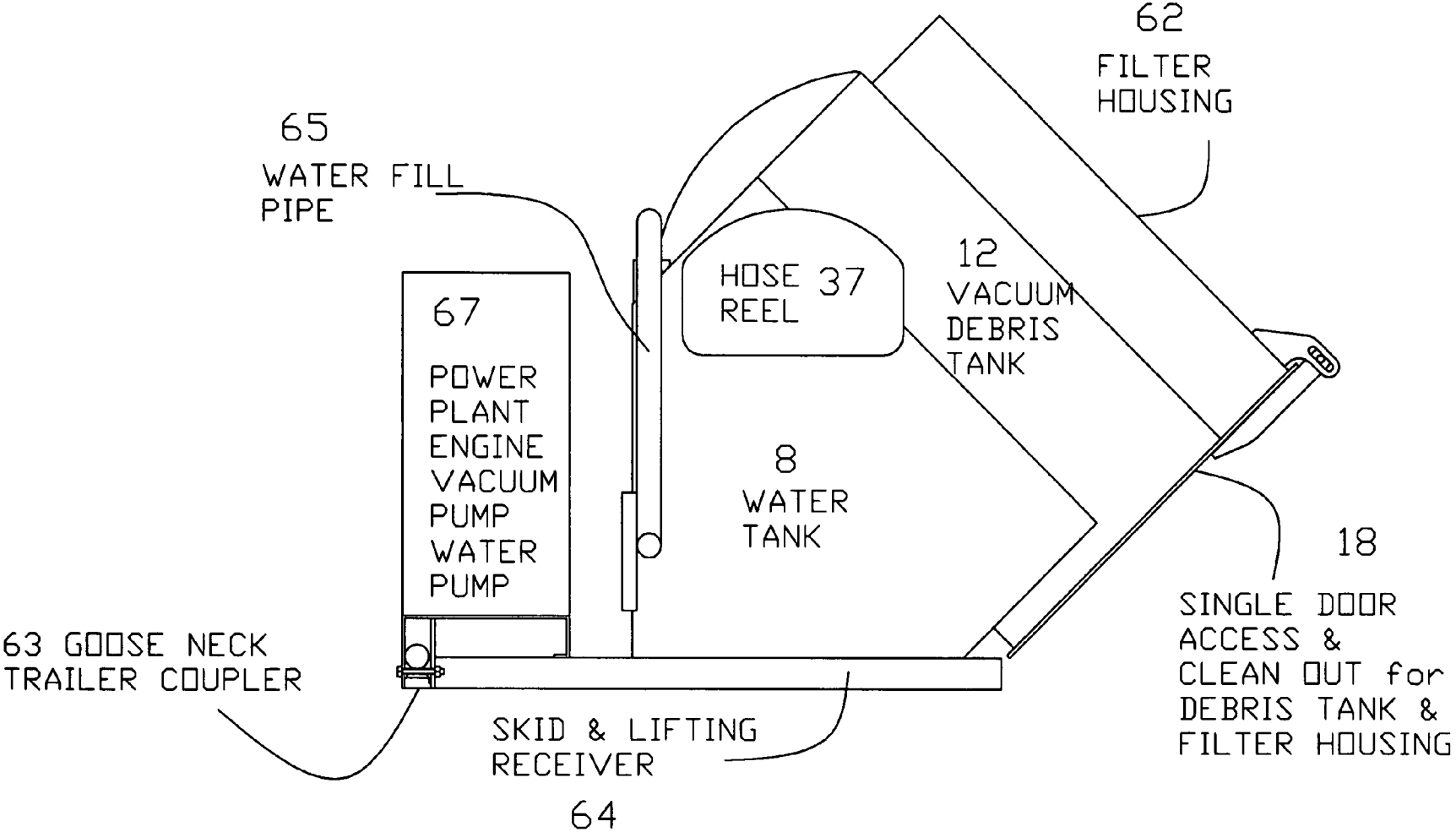
FIG. 1 is a side view of a vacuum container mounted at a fixed slope according to a preferred embodiment of the invention.

Referring to FIG. 1, a vacuum container (12) is mounted at a fixed slope and supported by a liquid water container (8). The fixed slope may be of sufficient angle to allow debris to empty by gravity when the access door (18) is opened. This arrangement creates a compact package unit, reduces floor space needed to contain both liquid container (8) and vacuum debris container (12) and condenses the weight of the water container (8) and vacuum debris container (12) combination. The dual container combination lends itself, by compactness, to use as a multifunctional convertible unit capable of being quickly converted from a skid mount unit (64) to a trailer mount unit, to a gooseneck hitch coupled (63) pick up truck bed unit, to a fork lift or skid steer transported unit. A filter housing (62) may be mounted piggyback onto the outer shell of the vacuum debris container (12) thus further compacting the space required for the system and again condensing weight and increasing the efficiency of interaction between the water tank (8), vacuum container (12) and filter housing (62). By flush mounting the clean out end of the filter housing (62) with the clean out access end of the vacuum container (12), a single door (18) may be utilized to access both vacuum container (12) and filter housing (62) simultaneously. A power plant (67) may consist of an engine, vacuum/blower, water pump, hydraulic pump, air compressor or electric generator and may be mounted with the vacuum tank and water tank. A hose reel (37) and water fill pipe (65) are attached to water tank (8).

Figure 2:
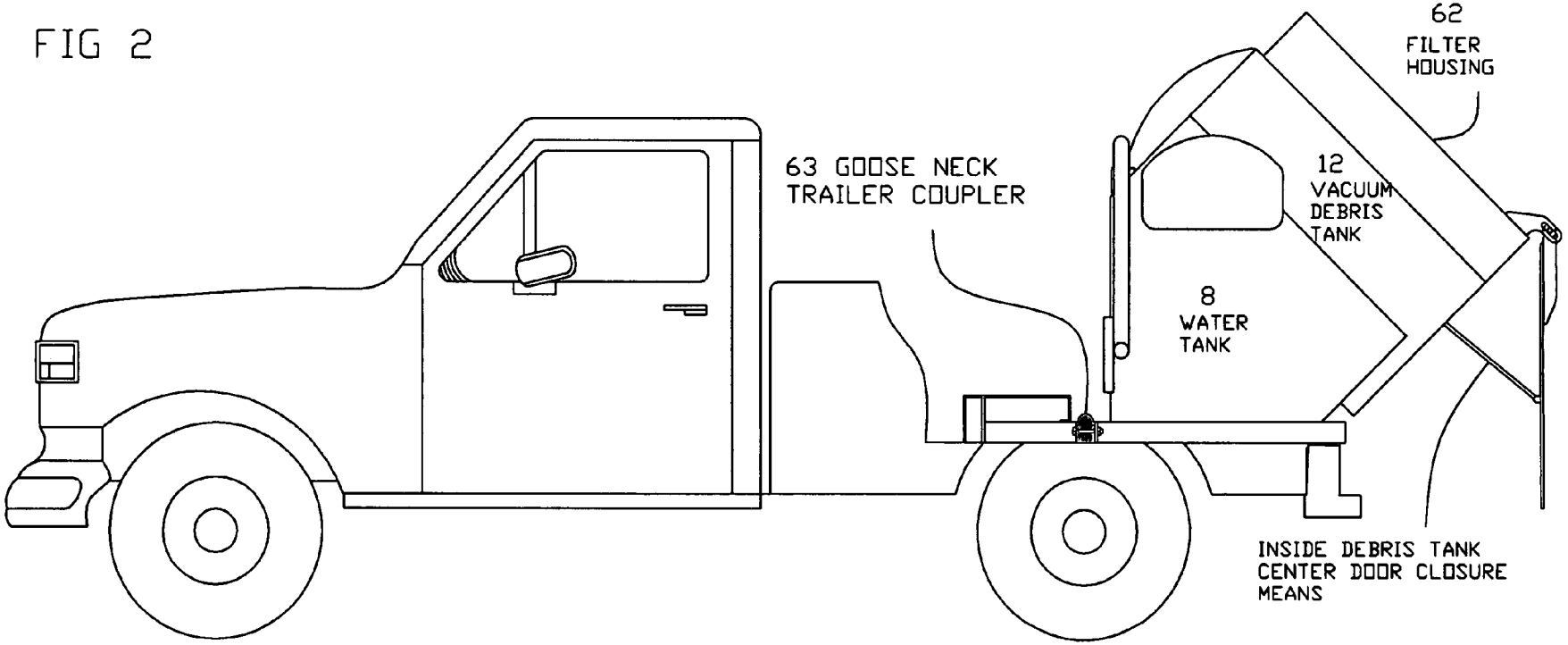
FIG. 2 is a side view of the vacuum container unit of FIG. 1, arranged on the bed of a pick-up, according to an embodiment of the invention.
Figure 6:
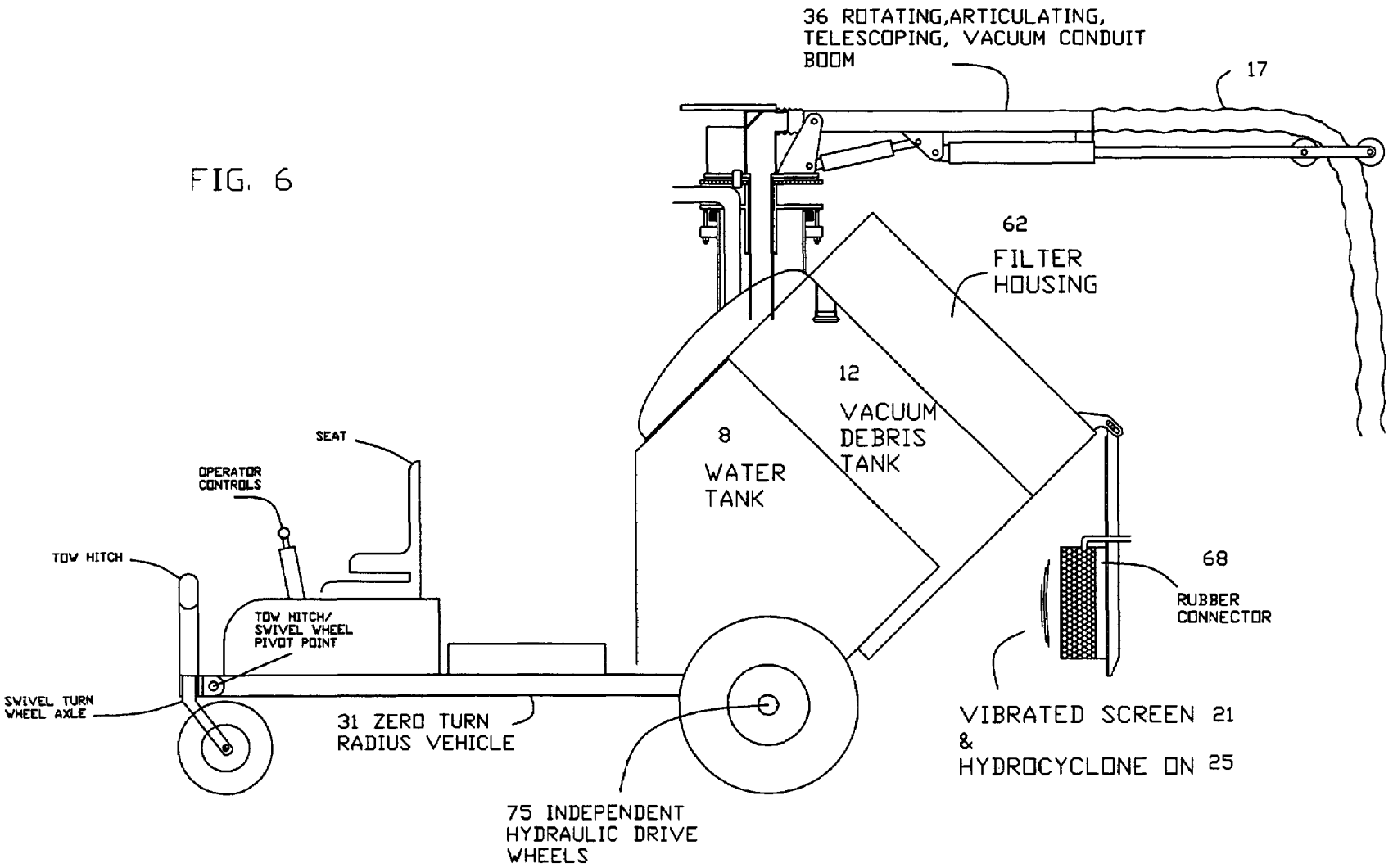
FIG. 6 is a side view of the vacuum container unit of FIG. 1, arranged on a zero turn radius vehicle according to an embodiment of the invention.

Referring to FIG. 2, a vacuum debris tank (12) is mounted at a fixed slope and supported by a water tank (8). A filter housing (62) is mounted on the vacuum debris tank (12). The water tank (8) is mounted on the bed of a truck secured by the goose neck trailer coupler (63) for easy transportation means. Alternative means for easy transportation can also be achieved through mounting the system on a trailer (31, FIG. 3), a skid steer (36, FIG. 4), or a zero turn radius vehicle (31, FIG. 6). The zero turn radius vehicle operates by maneuvering a tilt-away tow hitch and 360 degree swivel front wheels.

Figure 3:
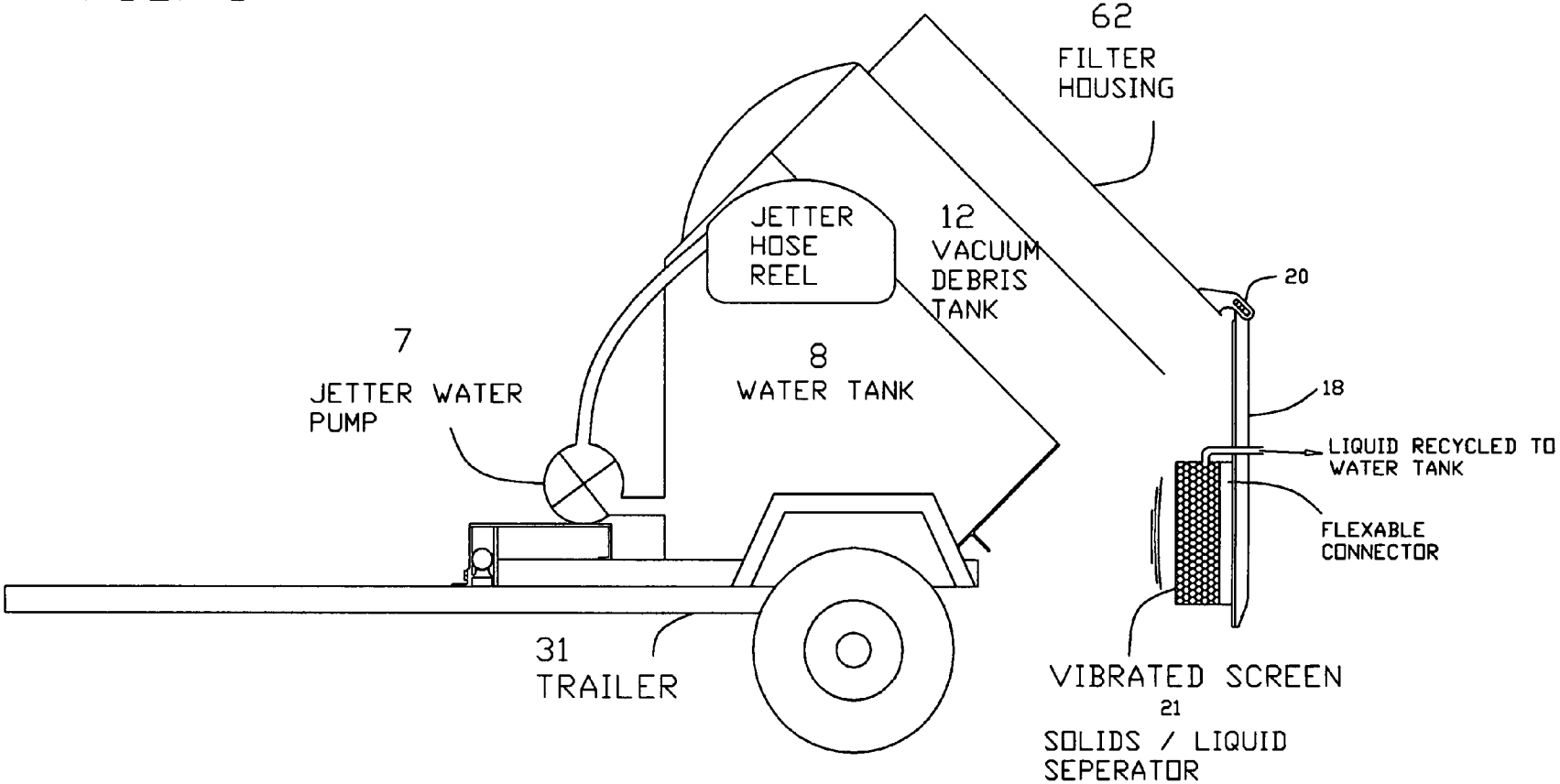
FIG. 3 is a side view of the vacuum container unit of FIG. 1, showing the solids/liquid separator and jetter water pump, according to an embodiment of the invention.
Figure 8:
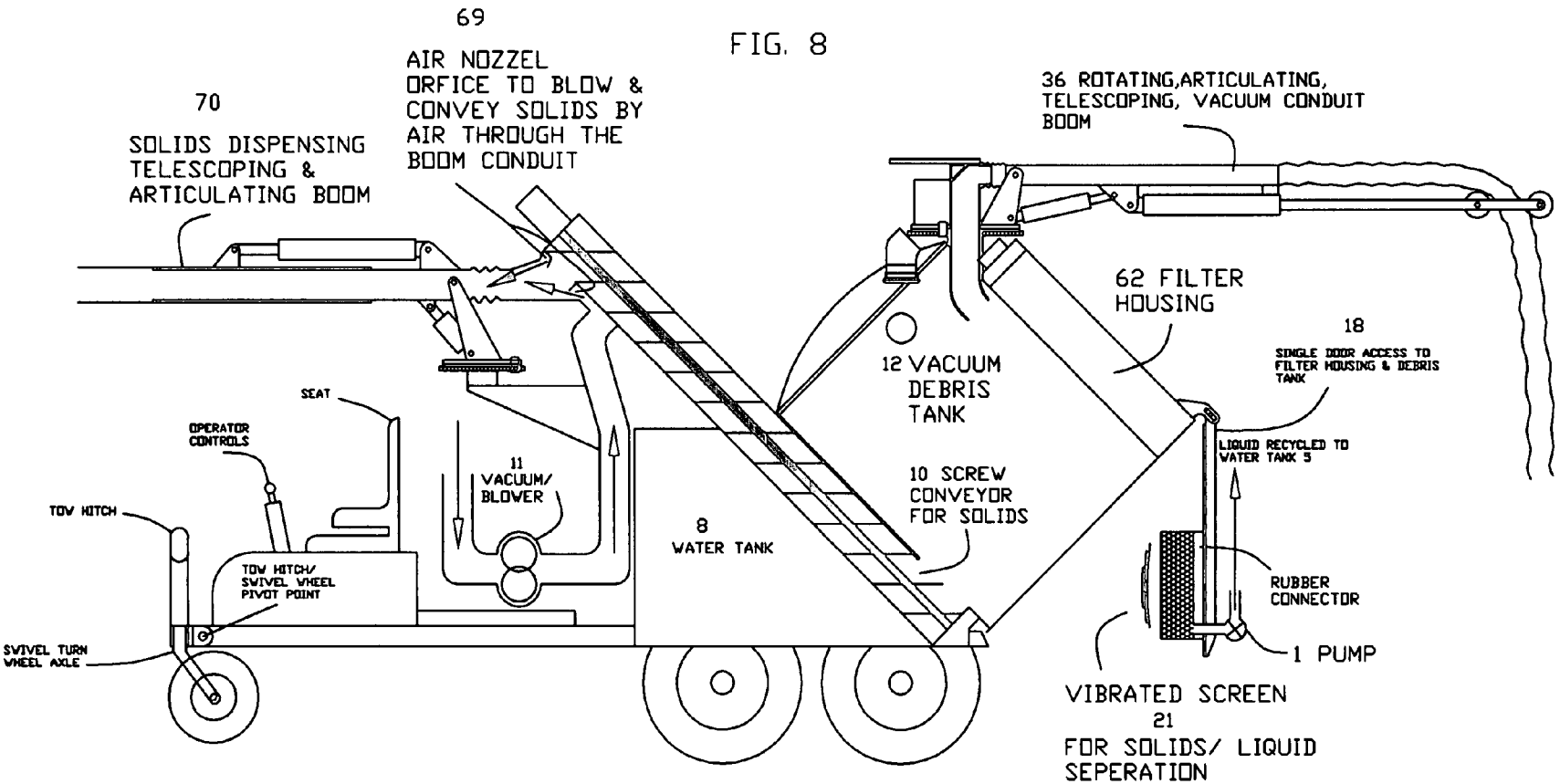
FIG. 8 is a side view of the vacuum container unit of FIG. 1, arranged on a zero turn radius vehicle according to an embodiment of the invention.

Referring to FIGS. 3 and 8, a vibrated screen (21) may be mounted by flexible connector (68) to the inside of the vacuum debris container access door (18) to separate liquids (2) from the solids (6), which have been vacuumed into the vacuum container (12). Liquids (2) may be piped from the inner part vibrated screen (21), through the access door (18) and into a pump dispensing means (1) strong enough to overcome vacuum within the vacuum container. A liquid conduit (5) recycles the liquid (2) through a liquid purification or sterilization means (74) then back to the water tank (8). The liquid purification or sterilization means (74) may include a hydro cyclone (25), vortex generator, sand filter, activated carbon, zealite, sterilizing elements, filters, ozone, peat, sawdust, shavings, or hydrocarbon absorbing means which may be added in the vacuum container (12) or external to the vacuum container (12) to clean, or sterilize the recycled liquid. A jetter water pump (7) is attached to the water tank (8) and used to pressurize the water to the hose conduit (5).

Figure 4:
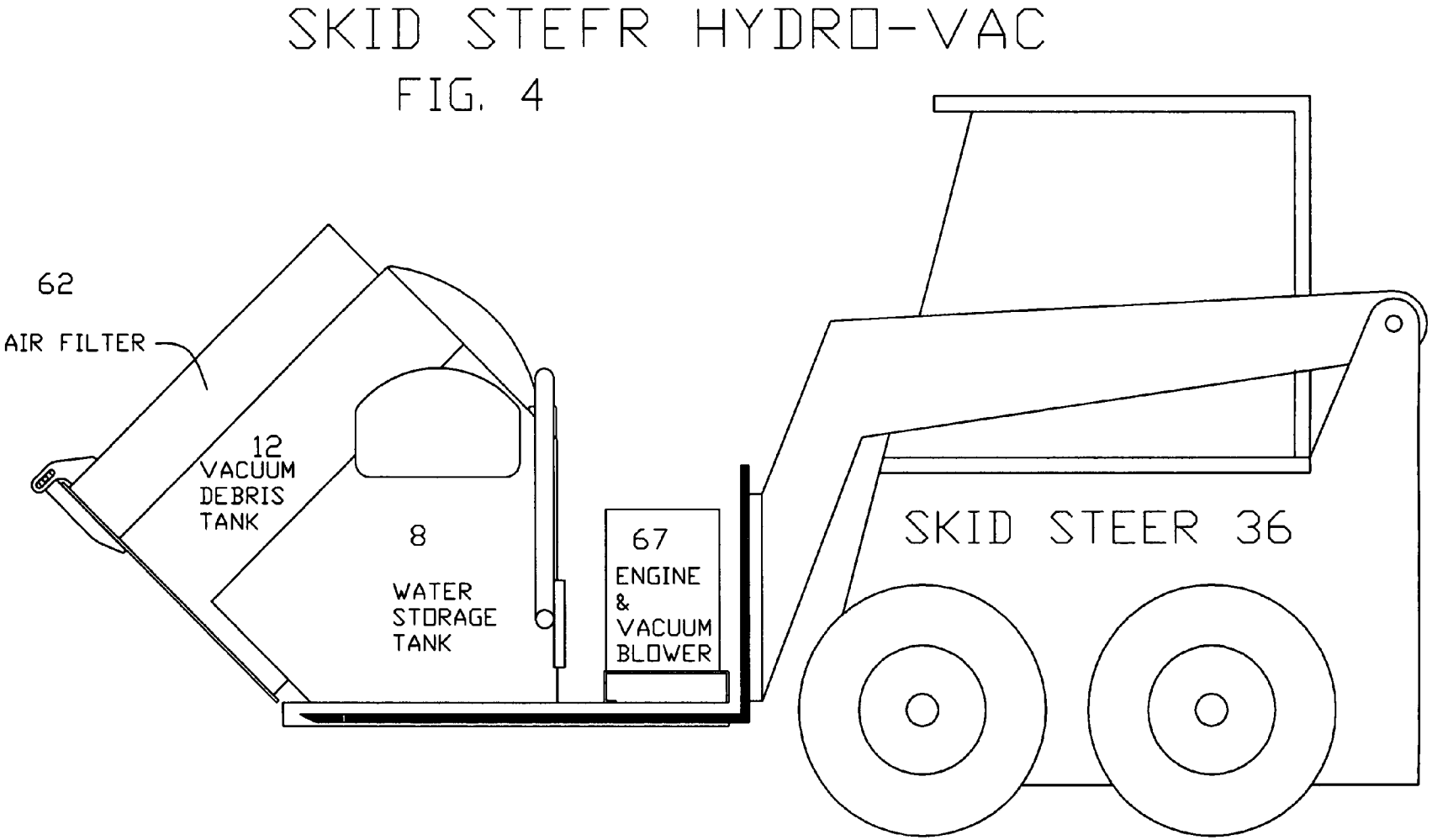
FIG. 4 is a side view of the vacuum container unit of FIG. 1, arranged on a skid steer according to an embodiment of the invention.
Figure 5:
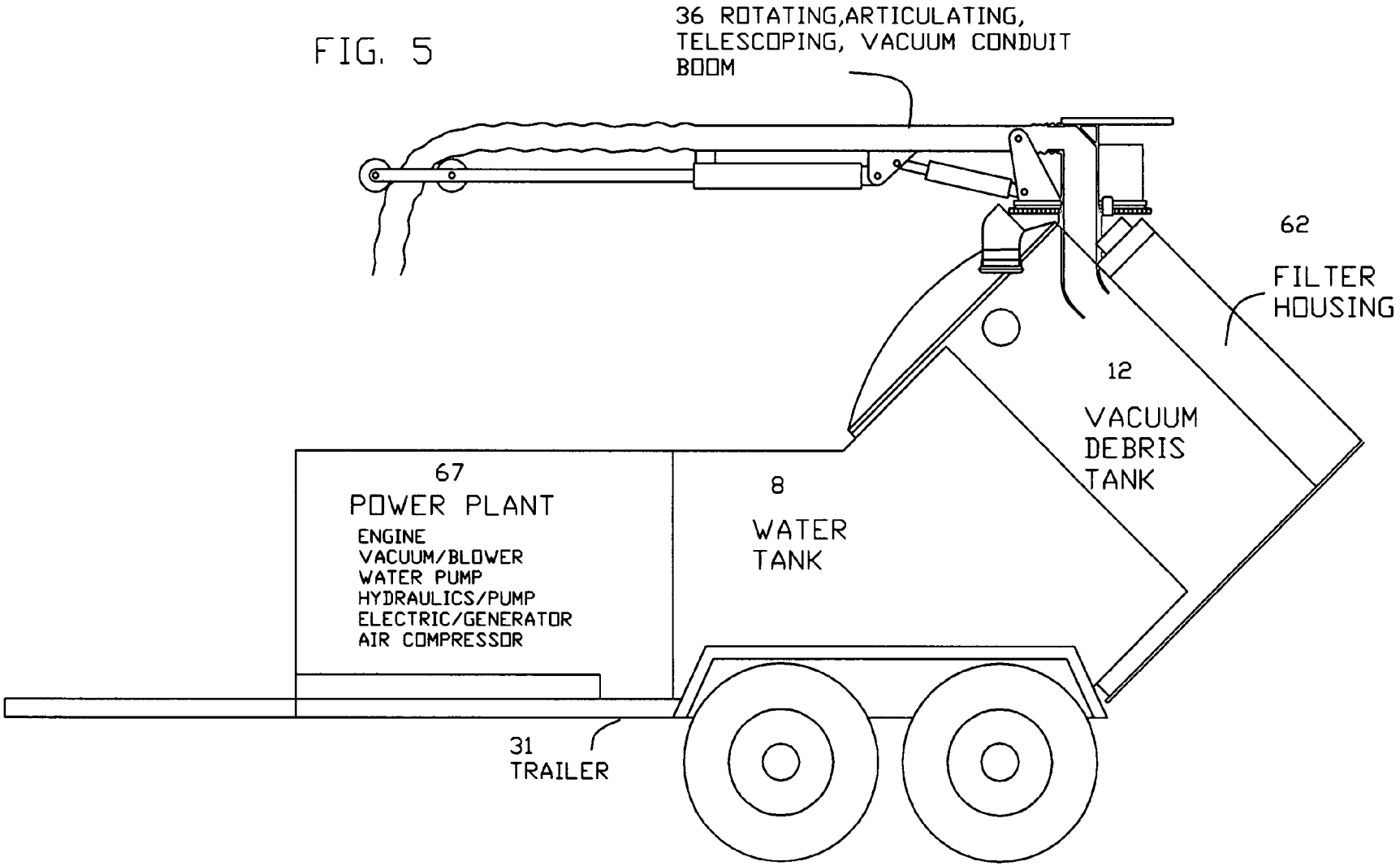
FIG. 5 is a side view of the vacuum container unit of FIG. 1, showing the rotating, articulating, telescoping, vacuum conduit boom, according to an embodiment of the invention.

Referring to FIG. 4, a skid steer (36) can be used for easy mobility of the mounted system as well as providing direct power to the system by connecting the system's engine and vacuum blower power supply (67) to the skid steer's hydraulics.

Referring to FIGS. 5-14, a powered, rotating, articulating, telescoping vacuum conduit boom (36) may be mounted onto the vacuum debris tank (12) in order to move the vacuum hose and it's attachments into place for vacuuming at a desired place to vacuum solids or liquids. The vacuum conduit boom (36) may be light weight to only move a vacuum hose or the boom (36) or may be strong enough to support and operate both a telescoping vacuum conduit and a bucket for digging or motorized attachments to pull a vacuum hose into and through a lateral drainage pipe which needs cleaned. The vacuum conduit boom (36) may also have multiple rotating swivel knuckles to aid in directing the vacuum hose into horizontal as well as vertical locations. The vacuum conduit boom (36) may also be equipped with hose reels and means to dispense both vacuum hoses and/or water jetter hoses to a point of use along with their individual attachments, such as jetter nozzles or tractors to pull a hose or operate sensors or digging or cleaning means.

The same boom (36) may have one or more hose reels attached so as to dispense vacuum hose (17), and/or water hose (5), and/or air hose, and/or hydraulic hose, and/or electrical power cords to a desired location for the purpose of vacuuming solids or liquids or making solids or liquids vacuumable, or monitoring or controlling the progress of the vacuuming process, or distributing a power source, for example, to a tractor or jetter nozzle, to pull a hose to a further location. The vacuum hose boom may also have multiple powered articulating arms, elbows, and knuckles to allow it to reach into manholes, or lateral lines leading to or from a manhole, or into silos or storage bens or railcar or tankers.

The vacuum conduit boom (36) may be constructed of sufficient strength to support and operate a bucket for digging as needed. The boom may also have quick change end attachments for vacuuming, surface cleaning with water pressure, demolition, grinding, jettering, or preparing surfaces as well as attachments to remove or replace manhole covers, or monitor or control the operation of attachments or sensors to detect obstacles or located utilities.

A screw conveyor (10) is used to move solids from the vacuum debris tank (12) to the solids dispensing telescoping and articulating boom (70) for disposal. The boom (70) could dispose of the solids within the bed of a dump truck (FIG. 10), within a disposal pile away from the digging site, or any other means necessary. The conveyor (10) may be a compacting screen conveyor emptying into an air conveyor discharged from a blower (11) to convey solids.

Figure 9:
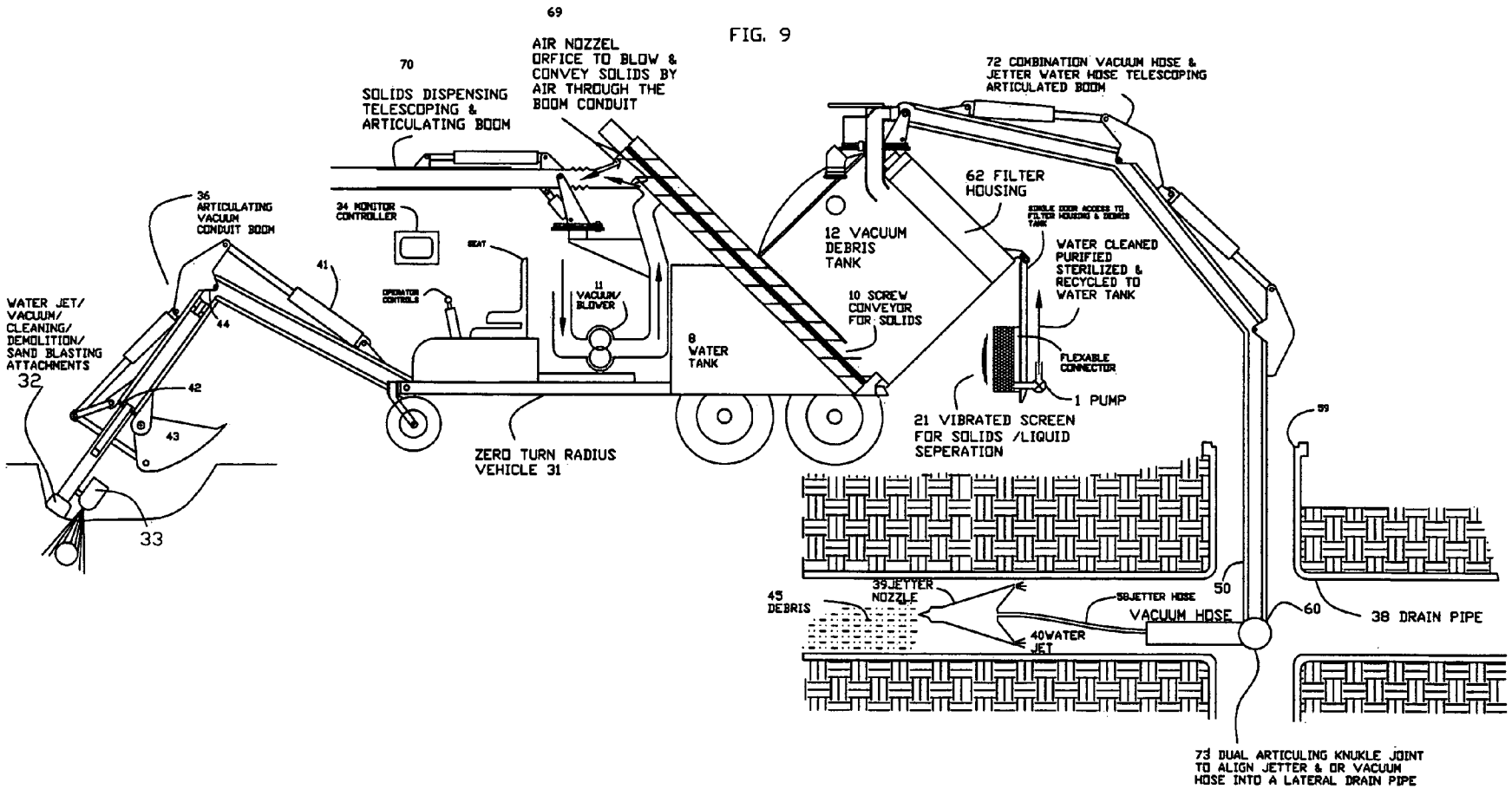
FIG. 9 is a side view of the vacuum container unit of FIG. 1, arranged on a zero turn radius vehicle according to an embodiment of the invention.
Figure 10:
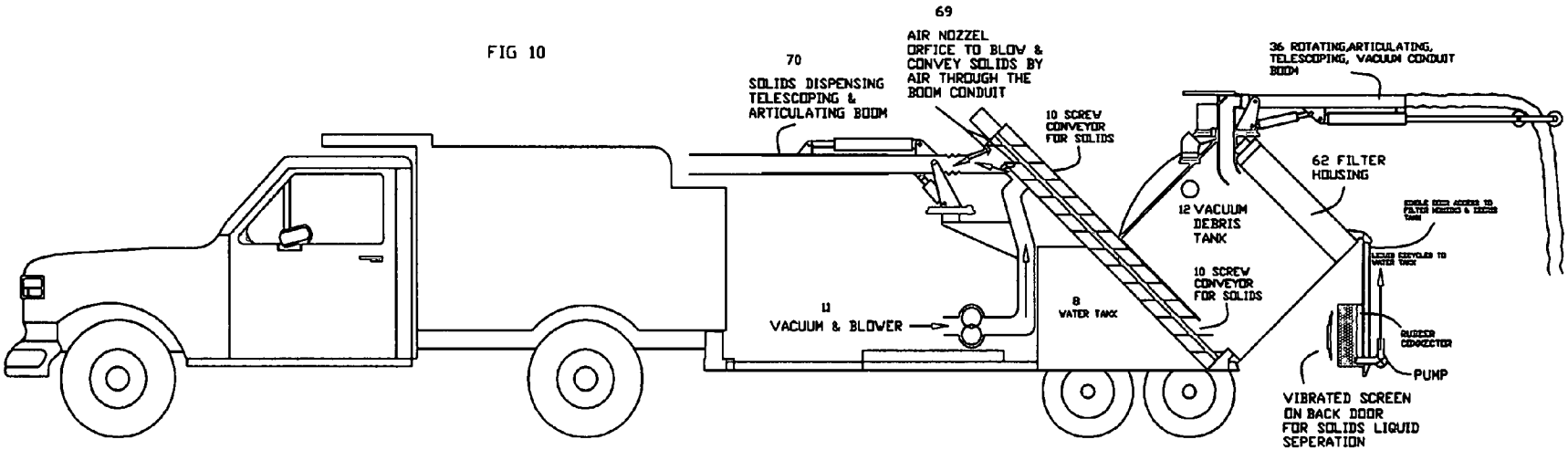
FIG. 10 is a side view of the vacuum container unit of FIG. 1, arranged on a trailer towed by a truck according to an embodiment of the invention.
Figure 11:
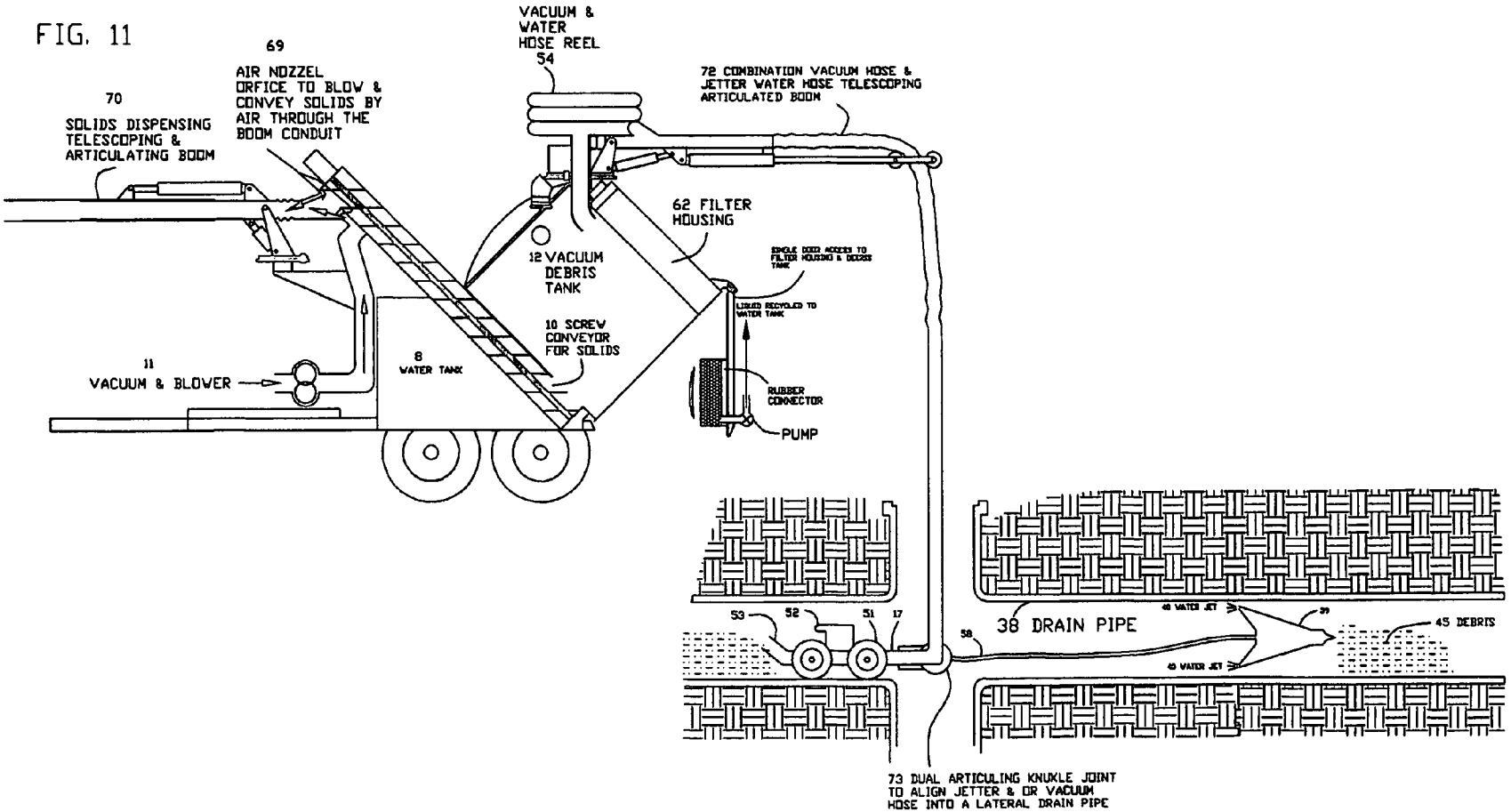
FIG. 11 is a side view of the vacuum container unit of FIG. 1 according to an embodiment of the invention.
Figure 12:
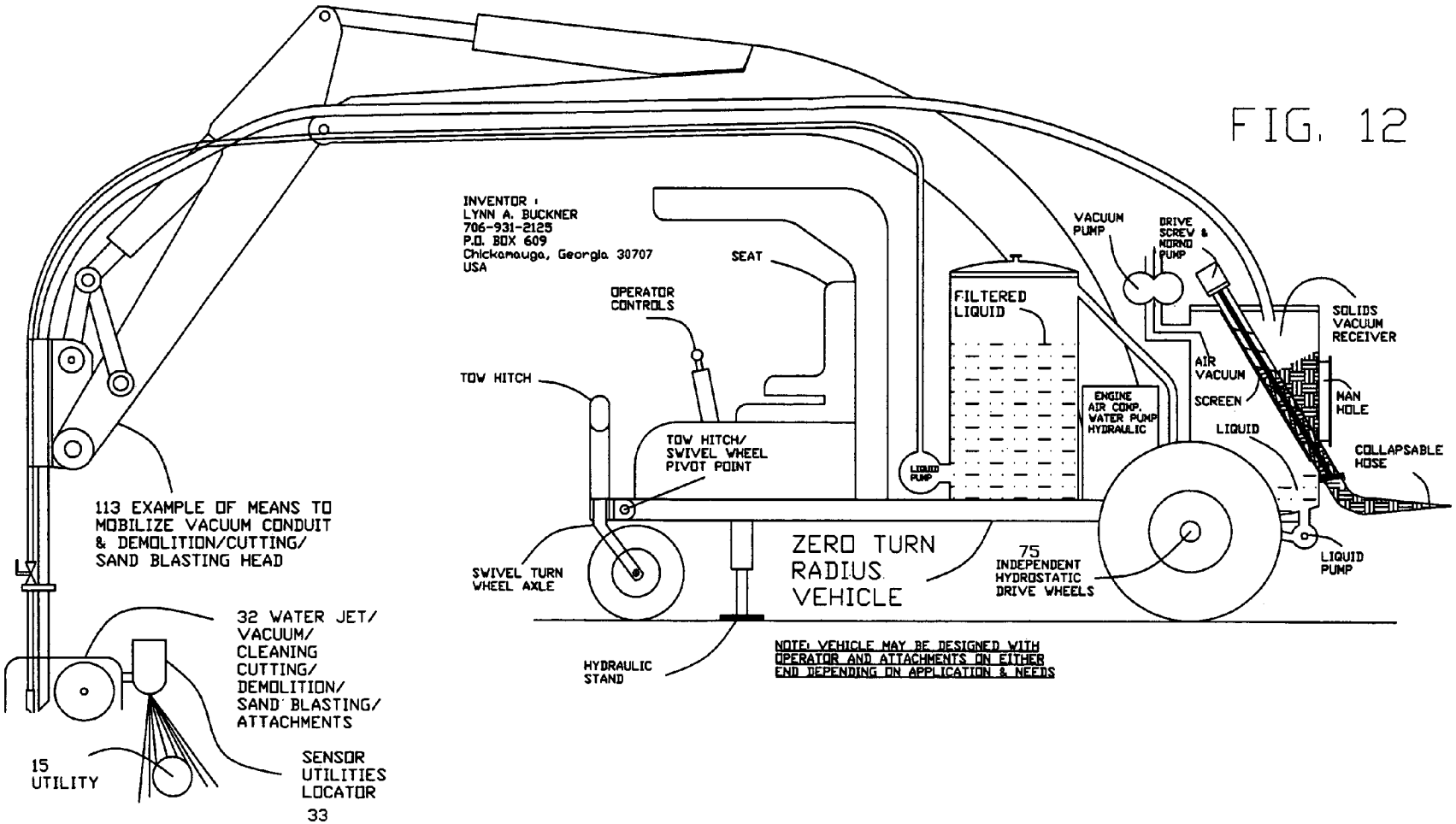
FIG. 12 is a side view of the vacuum container unit of FIG. I arranged on a zero turn radius vehicle according to an embodiment of the invention.
Figure 13:
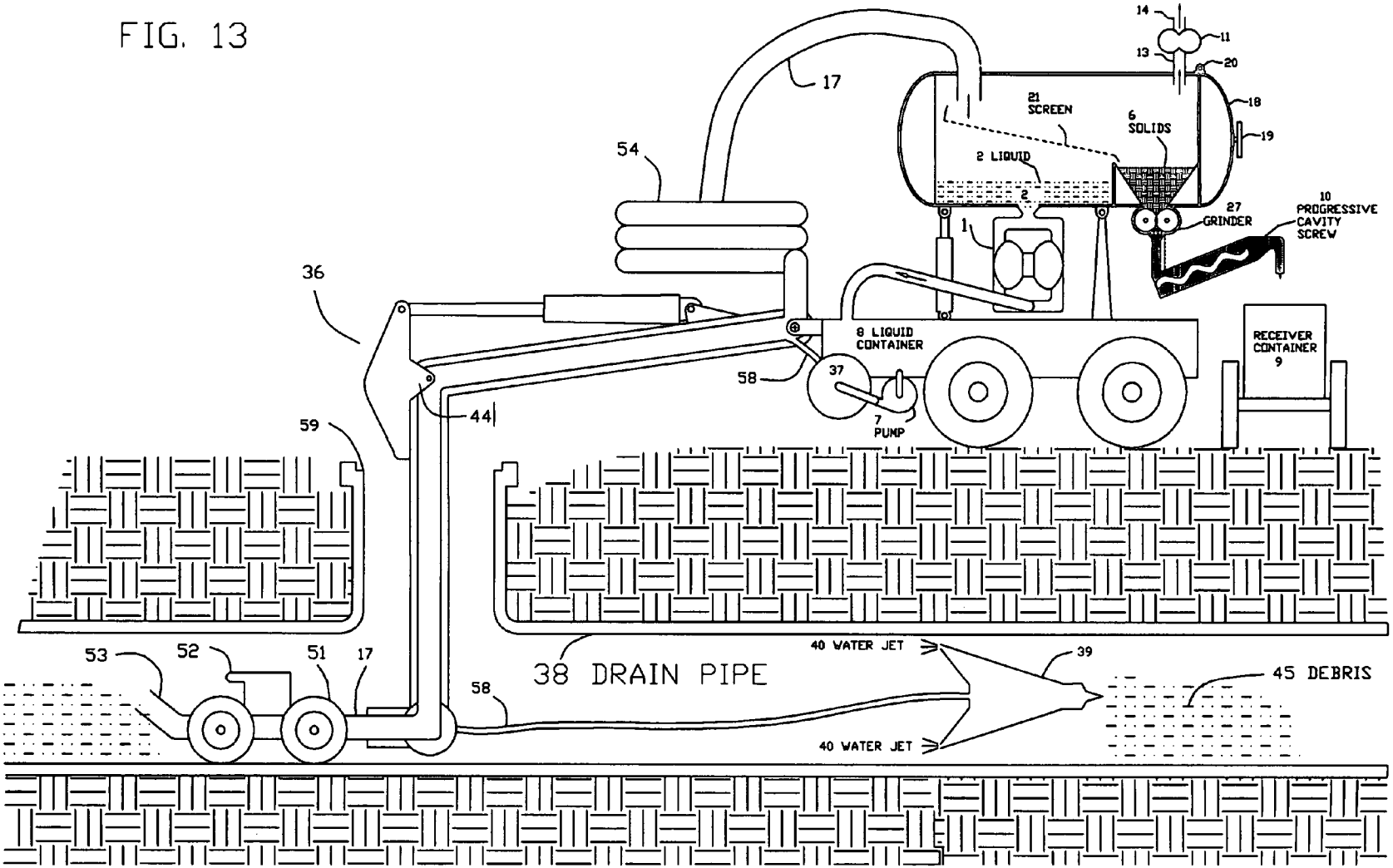
FIG. 13 is a side view of a vacuum container unit according to an embodiment of the invention.
Figure 14:
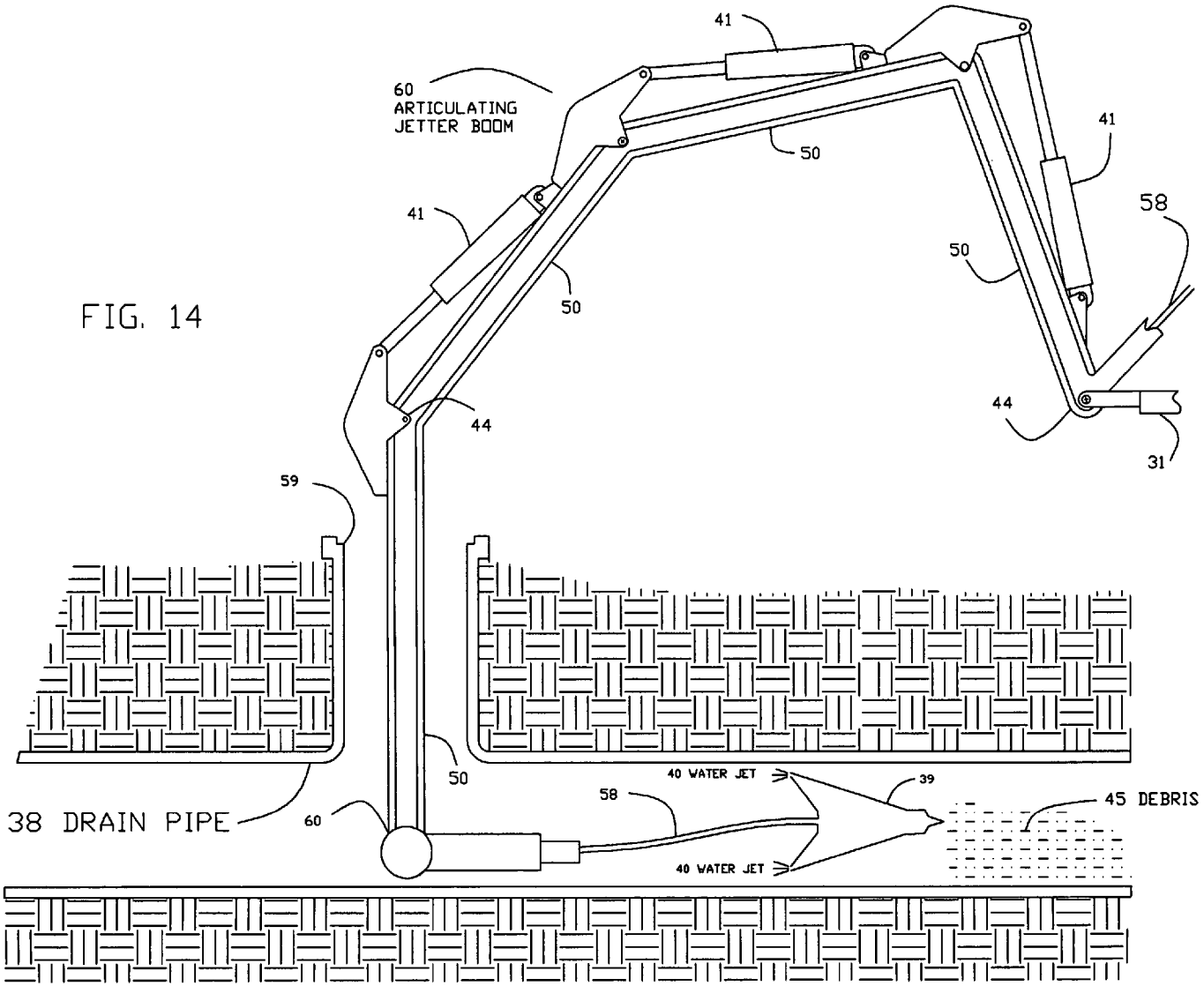
FIG. 14 is a side view of an articulating jetter boom according to an embodiment of the invention.
Figure 15:
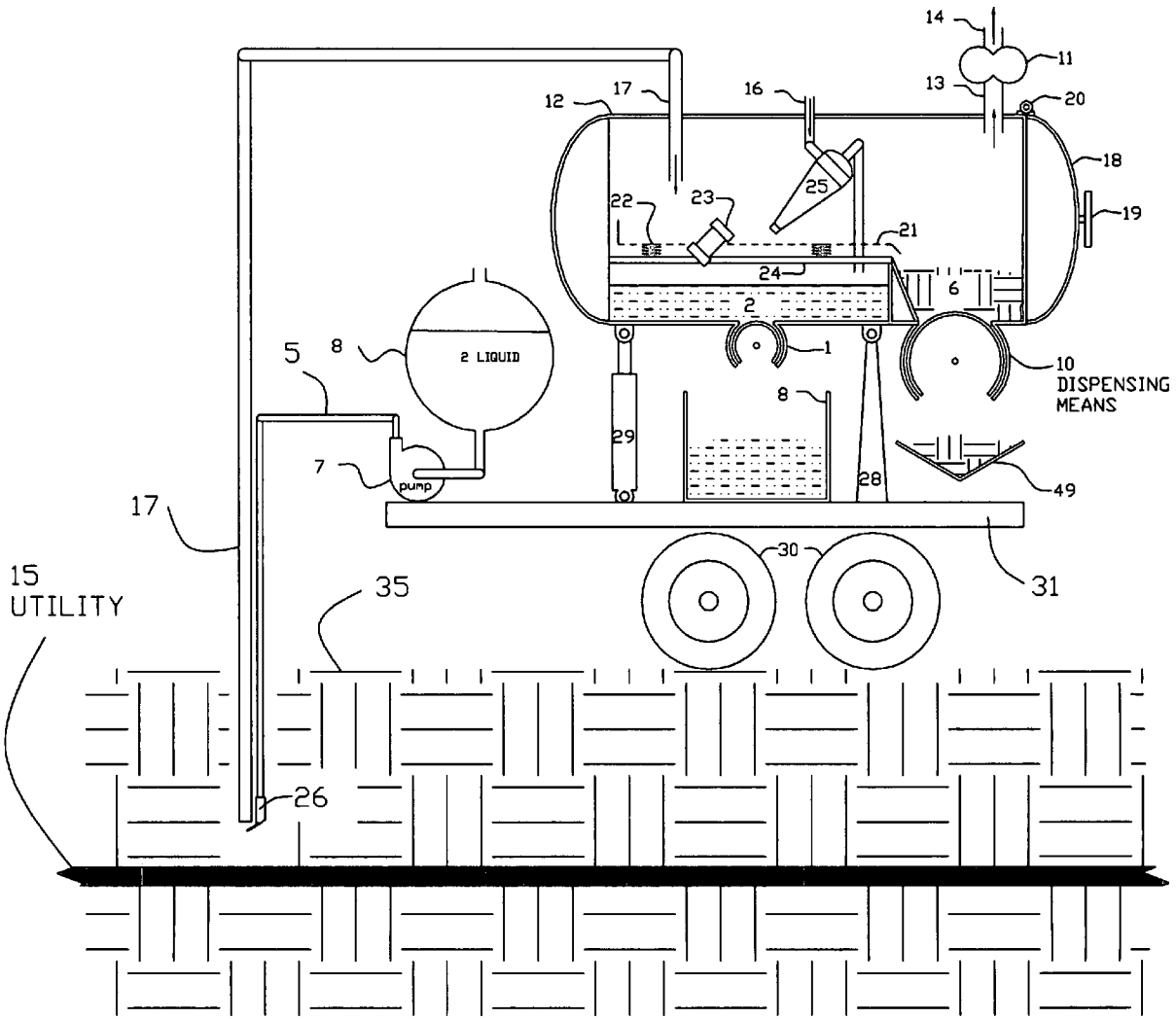
FIG. 15 is a side view of a vacuum container according to an embodiment of the invention.
Figure 16:
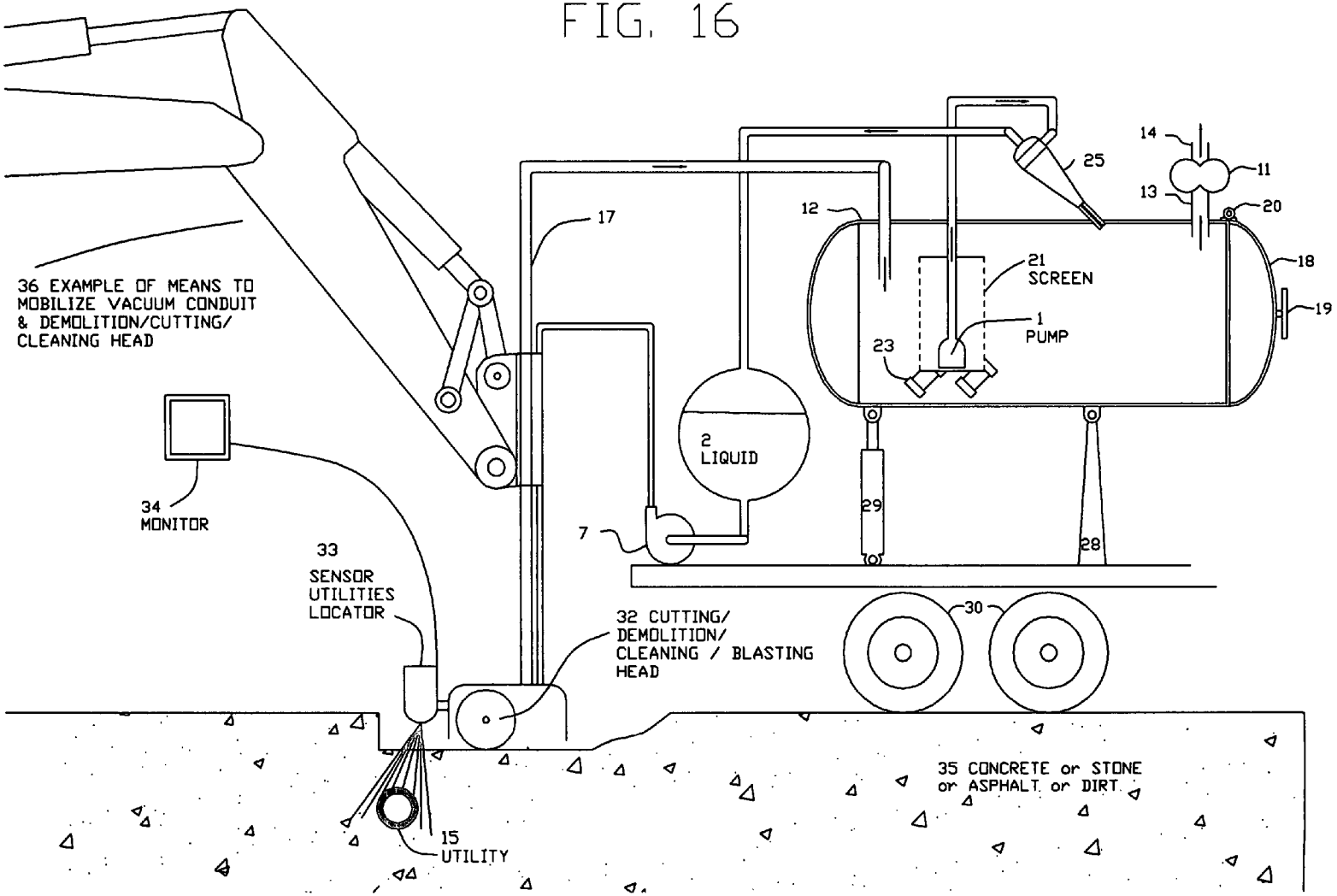
FIG. 16 is a side view of a vacuum container unit according to an embodiment of the invention.
Figure 17:
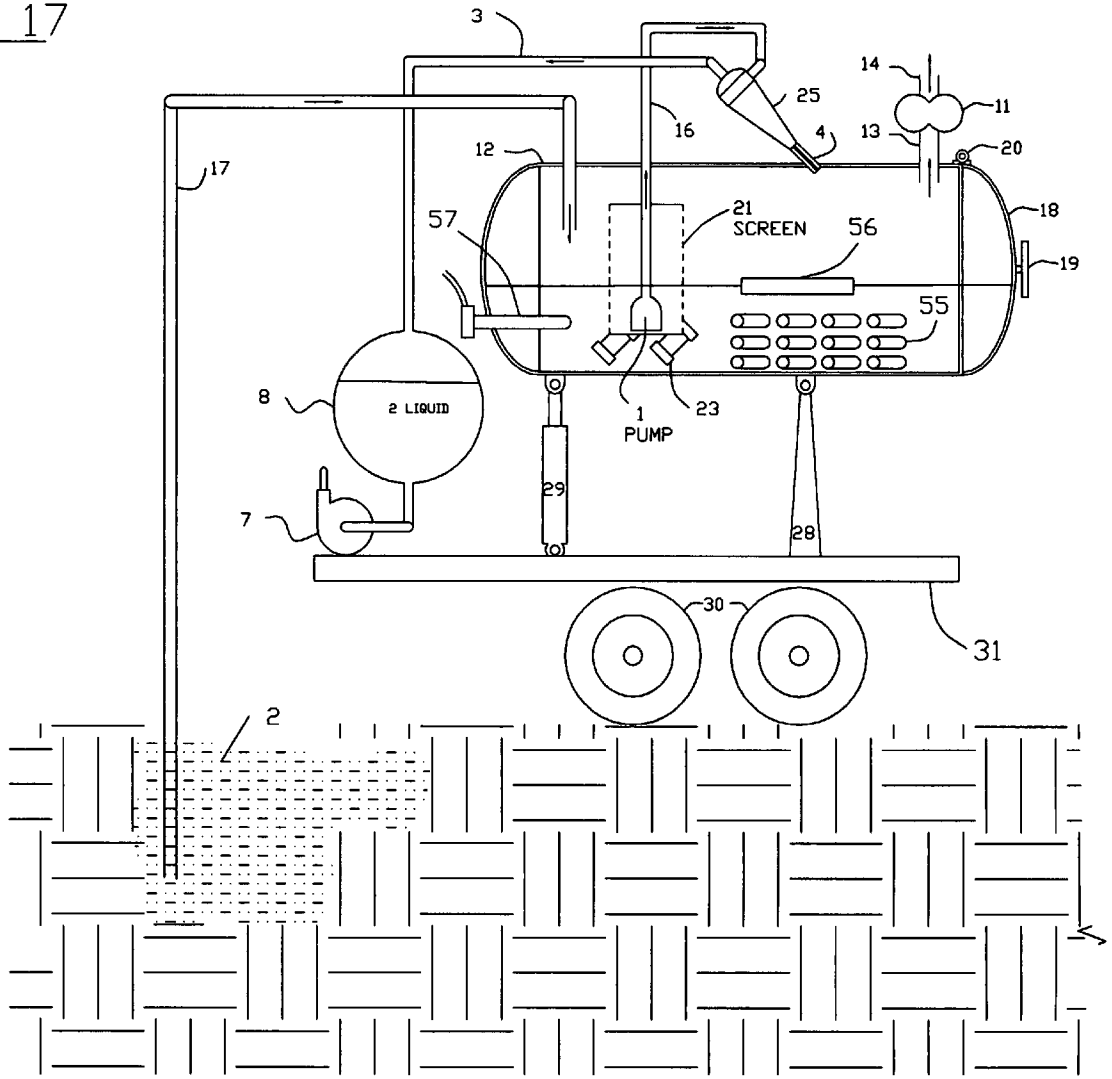
FIG. 17 is a side view of a vacuum container unit according to an embodiment of the invention.
Figure 18:
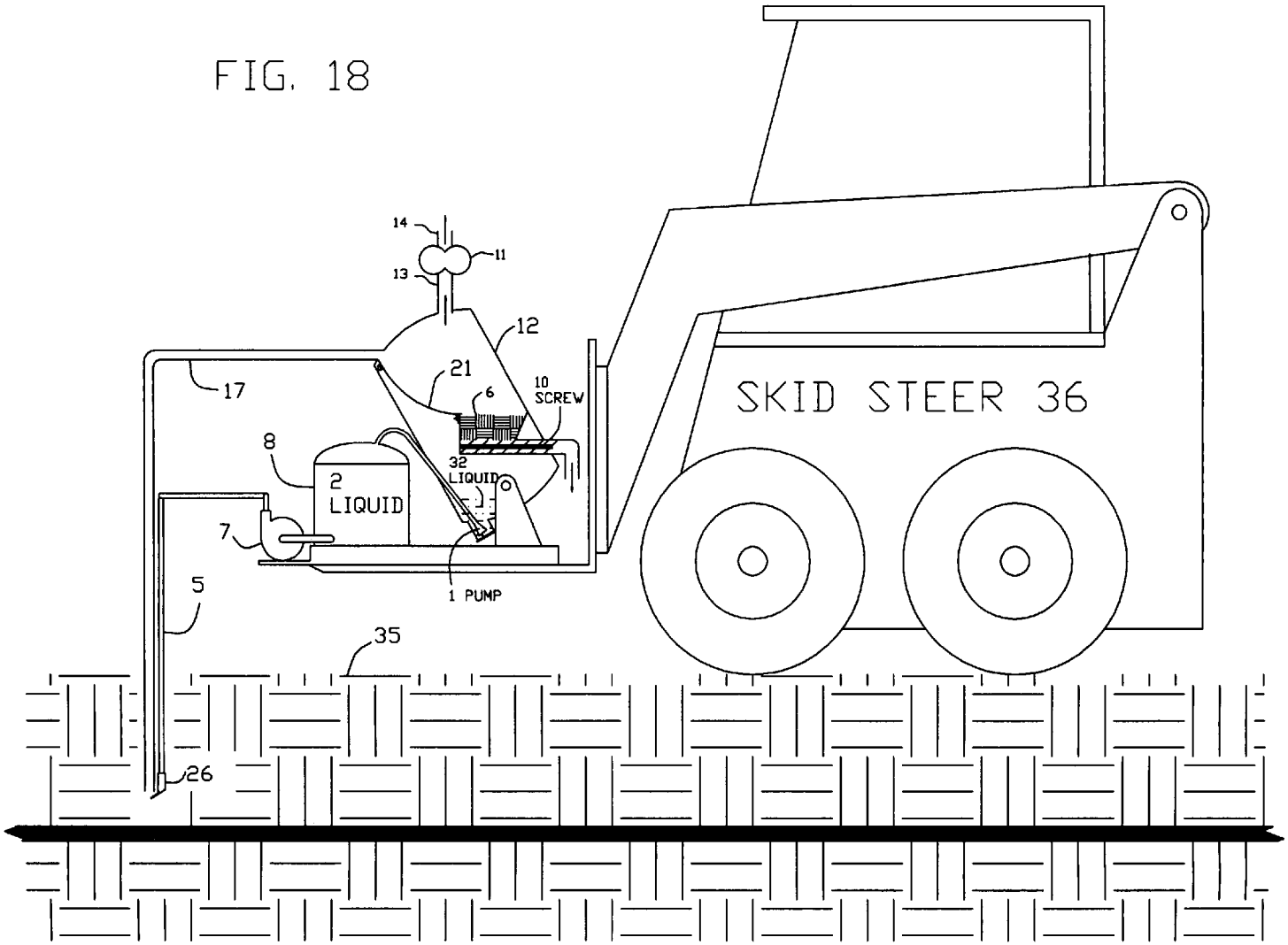
FIG. 18 is a side view of a vacuum container unit arranged on a skid steer, according to an embodiment of the invention.
Figure 19:
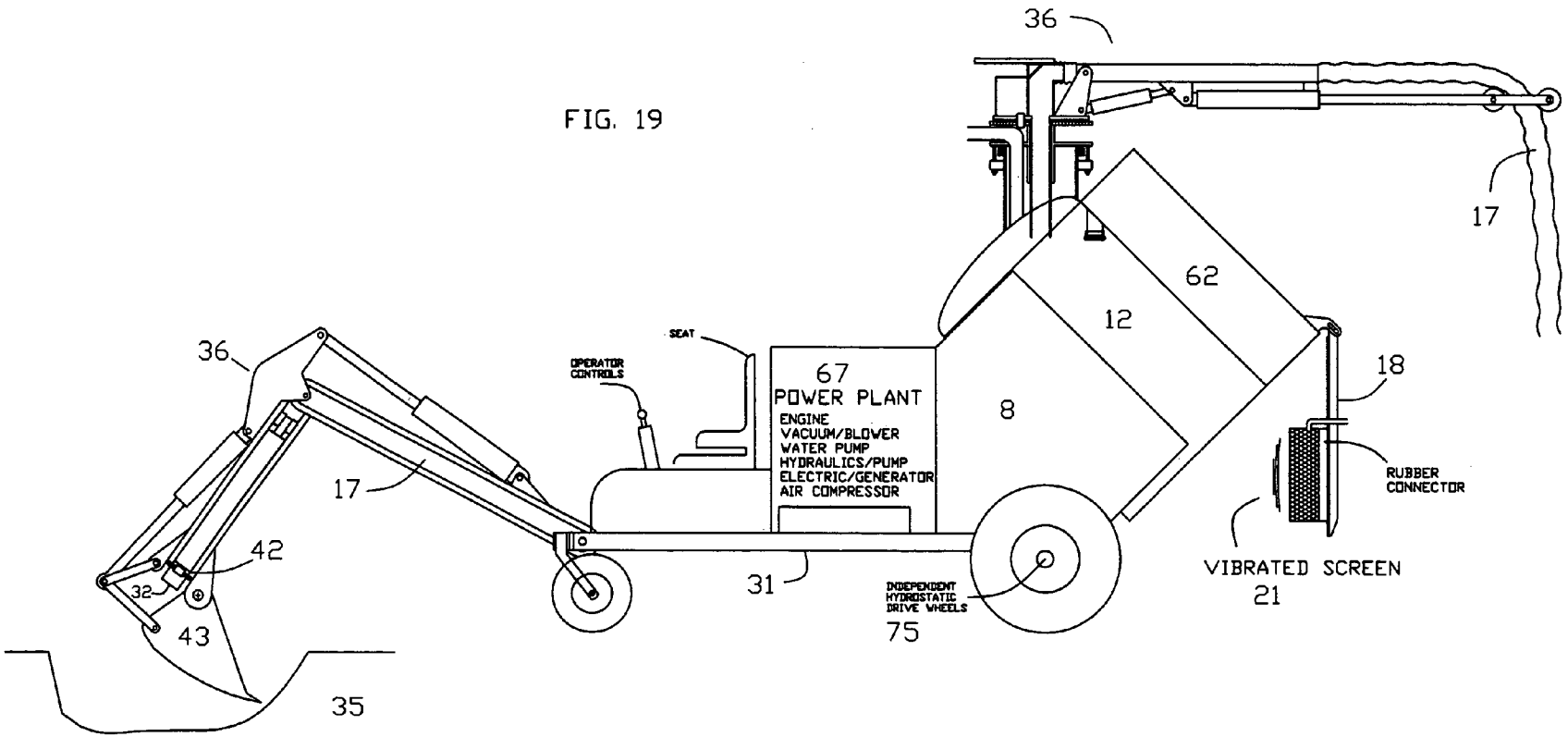
FIG. 19 is a side view of the vacuum container unit of FIG. 1 arranged on a zero turn radius vehicle, according to an embodiment of the invention.
Figure 20:
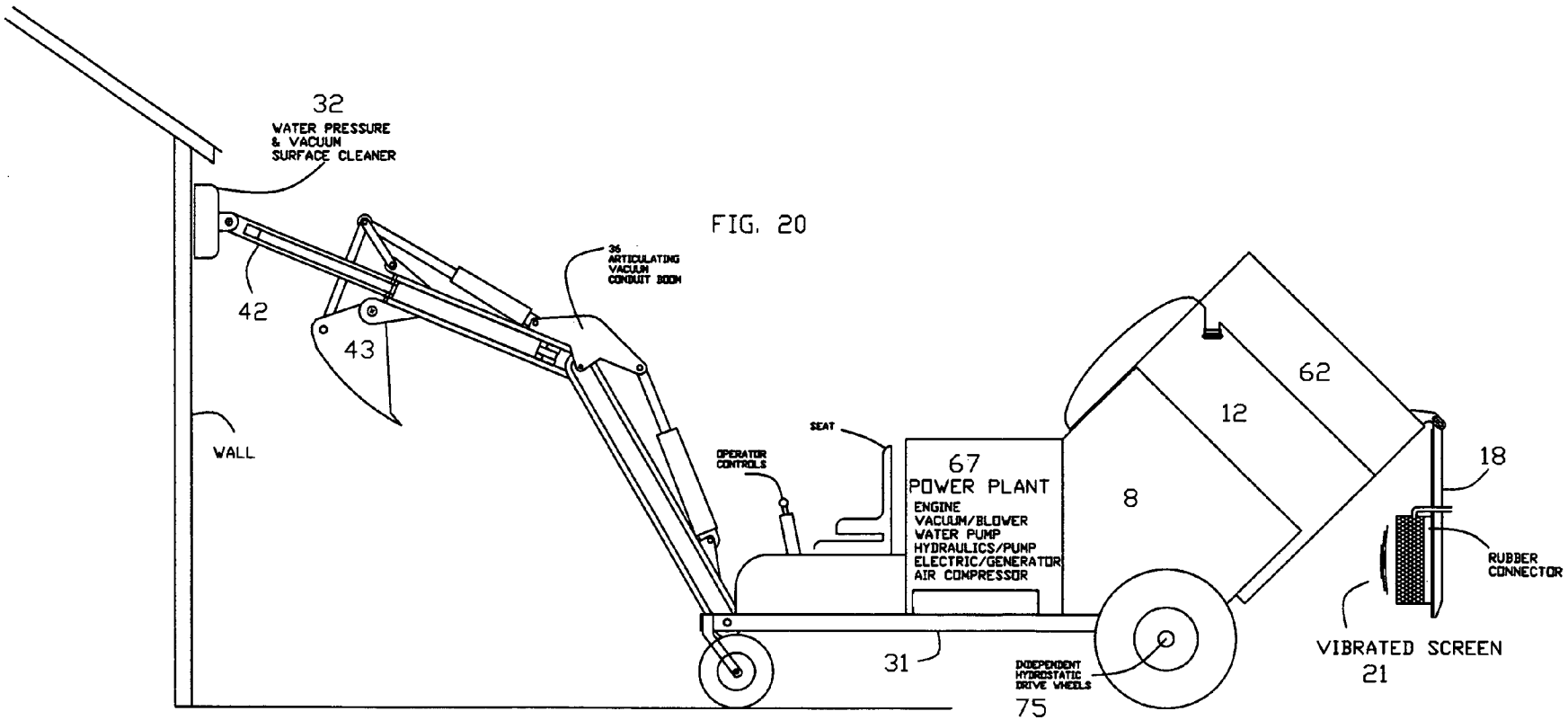
FIG. 20 is a side view of the vacuum container unit of FIG. 1 arranged on a zero turn radius vehicle according to an embodiment of the invention.
Figure 21:
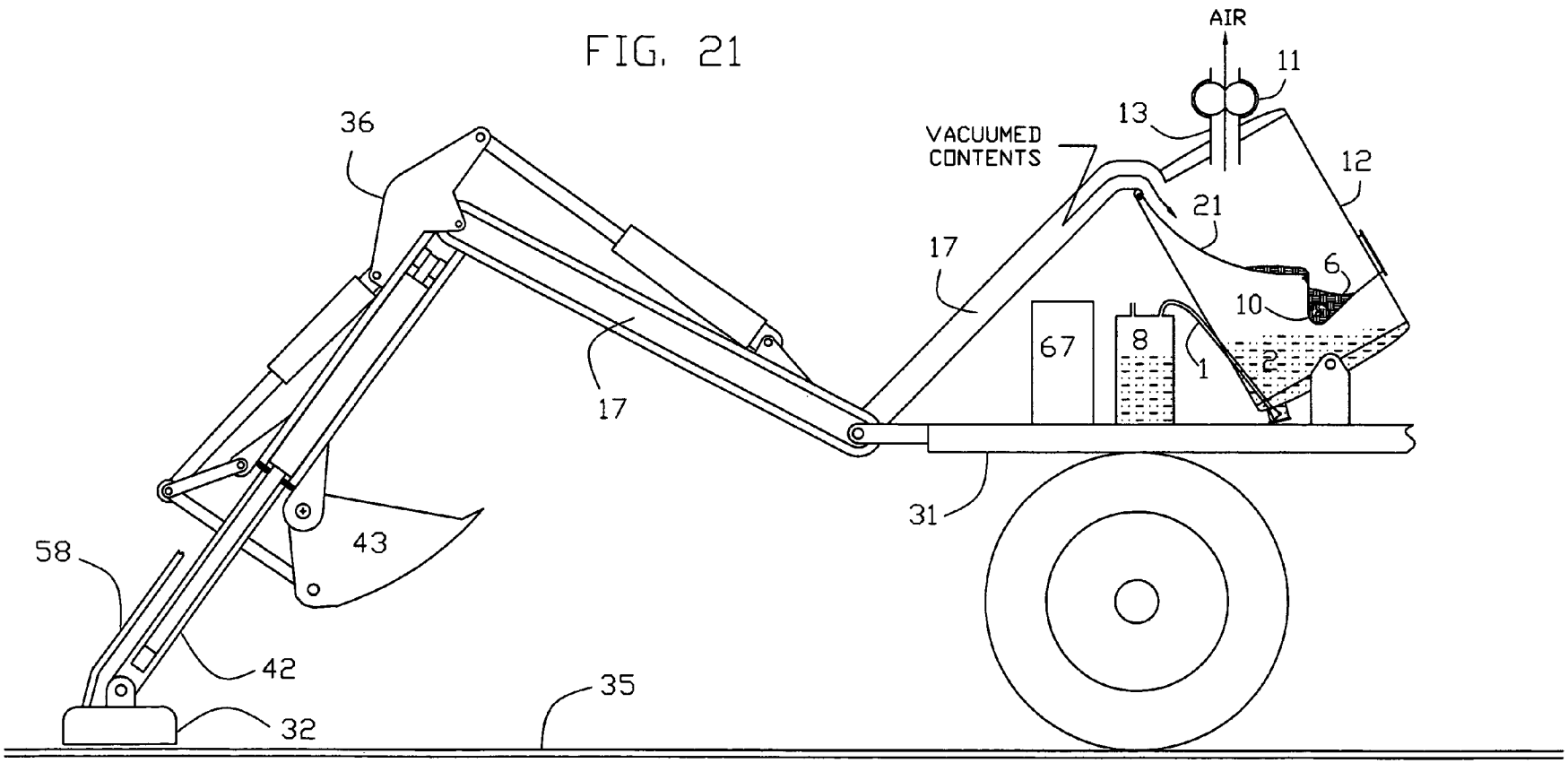
FIG. 21 is a side view of a vacuum container unit according to an embodiment of the invention.
Figure 22:
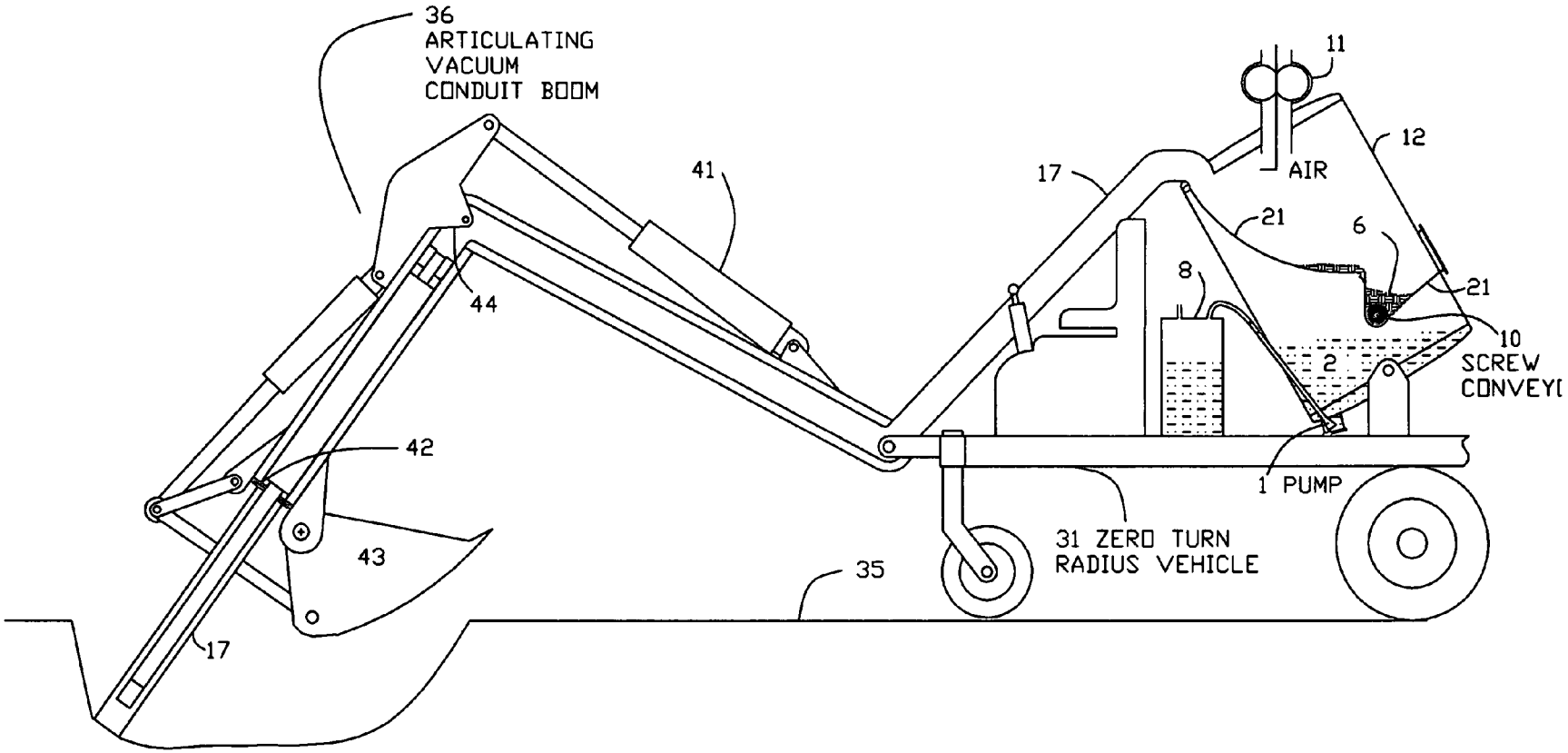
FIG. 22 is a side view of a vacuum container unit arranged on a zero turn radius vehicle, according to an embodiment of the invention.
Figure 23:
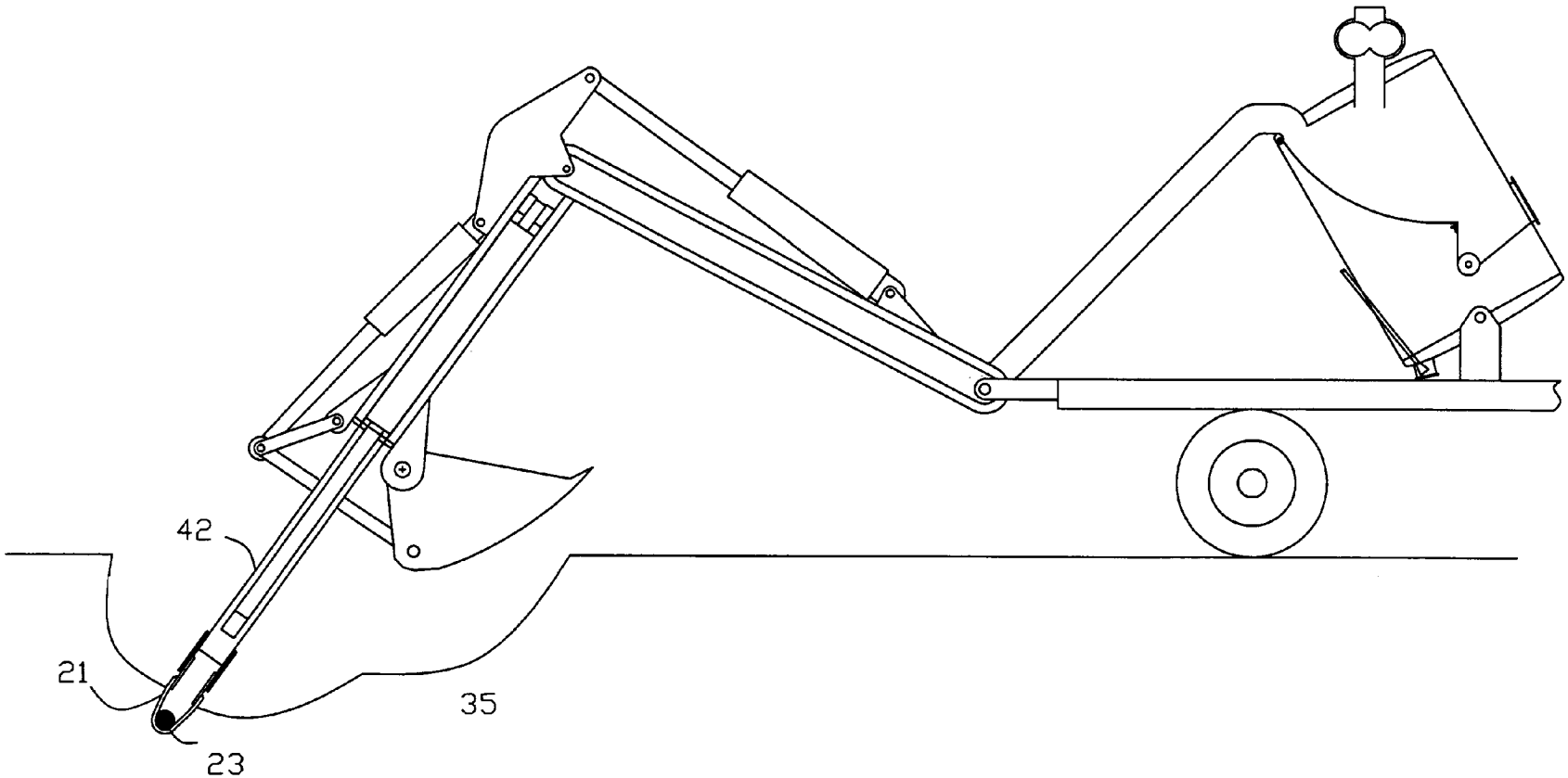
FIG. 23 is a side view of a vacuum container unit according to an embodiment of the invention.
Figure 24:
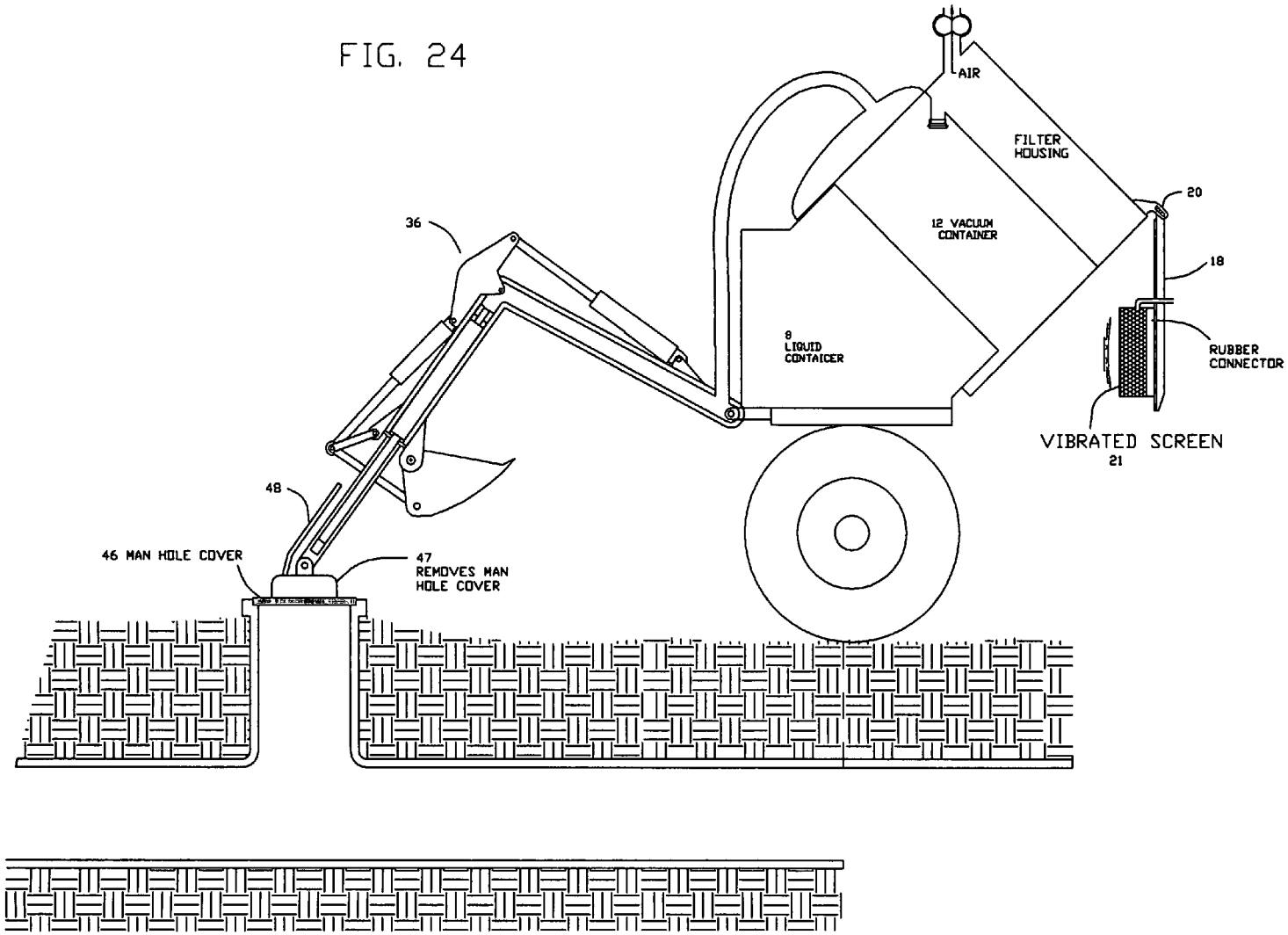
FIG. 24 is a side view of the vacuum container unit of FIG. 1 according to an embodiment of the invention.
Figure 25A:
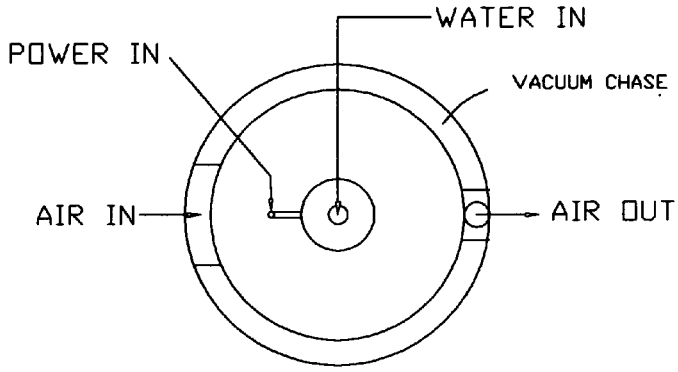
FIG. 25*a* is a plan view of a rotating head sprayer according to an embodiment of the invention.
Figure 25B:
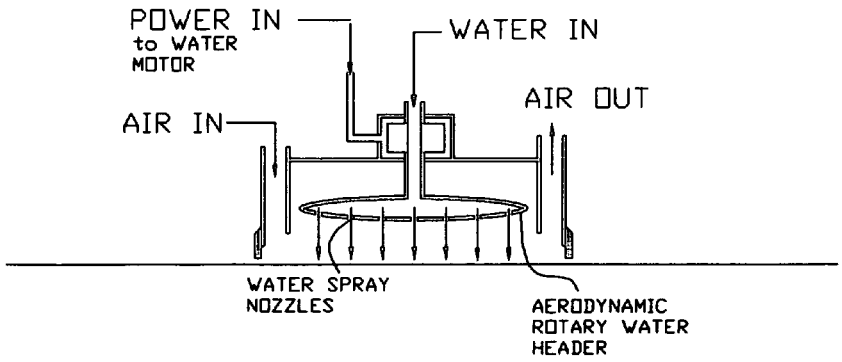
FIG. 25*b* is a side sectional view of a sprayer according to an embodiment of the invention.

Referring to FIG. 9, a sensor/monitor may be used in order to detect buried utilities for the purpose of finding the utilities so they can be serviced, or in order to avoid damage to the utilities. The sensor my be located on the end of an articulating vacuum conduit boom (36) and be connected to a monitor located near the operator for ease of viewing. An attachment on the end of the articulating vacuum conduit boom (36) may include one or more of a water jet, vacuum, cleaning, demolition or sand blasting attachment in order to help in loosening the digging area.

A jetter nozzle (39) may be attached to a jetter hose (58) on the end of a dual articulating knuckle joint to align the jetter and/or vacuum hose (17) into a lateral drainpipe or manhole lateral. Water jets (40) on the jetter nozzle (39) are used to propel debris (45) towards the vacuum hose (17) and to move the jetter nozzle (39) along the drainpipe (38). A vacuum conduit tractor (51) may also be used to clean debris by clearing debris with an articulating suction head (53) connected to the vacuum conduit (17) and having a vacuum conduit tractor sensor controller (52) to guide the vehicle. Various other means of clearing the drainpipe (38) could be employed.

A vacuum and water hose reel (54) may be attached (FIG. 11) in order to keep the vacuum and water hose lines clear from kinks or getting tangled in order to provide for an easy means to dispense and retract the various hoses.

Figure 26:
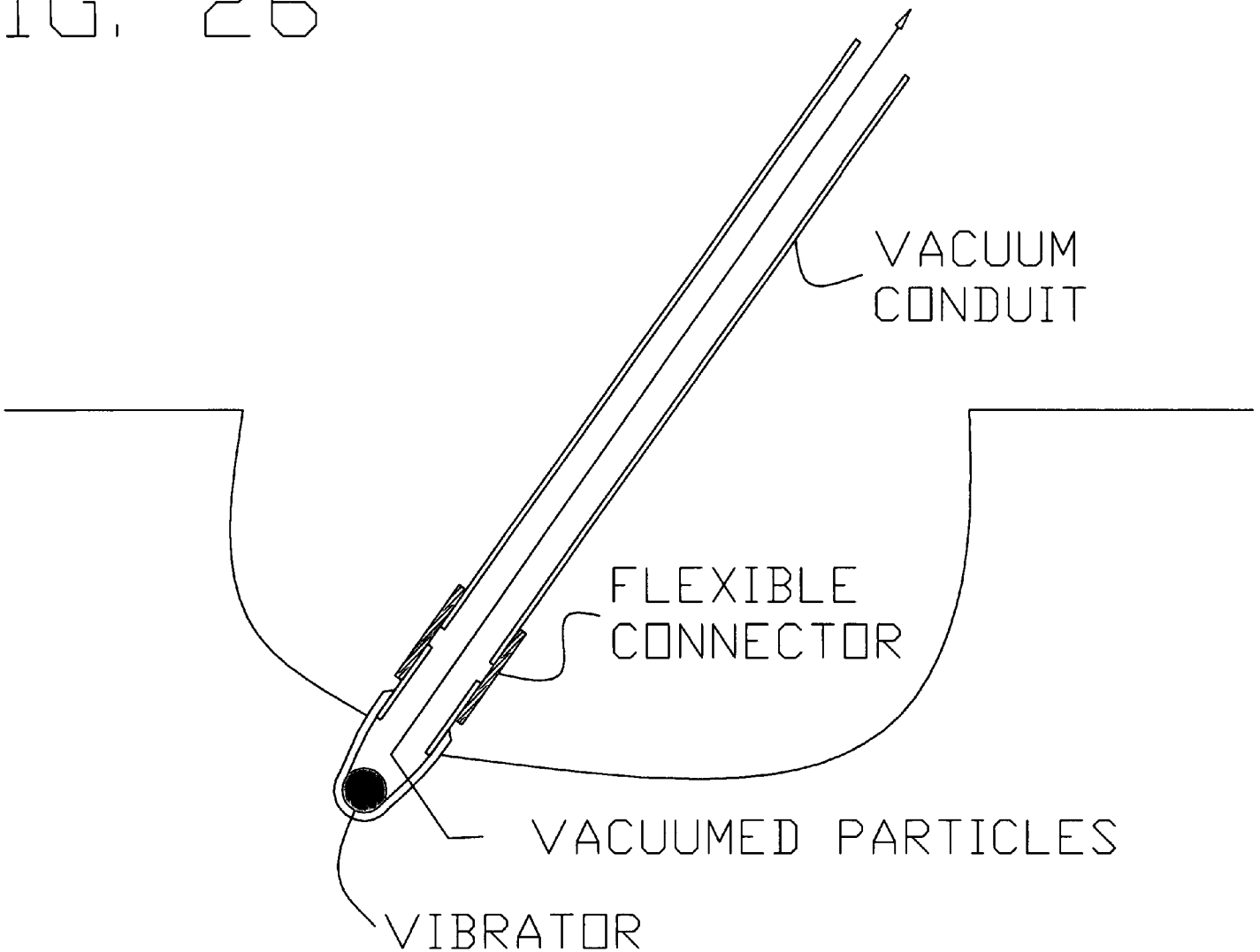
FIG. 26 is a side view of the vacuum conduit according to an embodiment of the invention.

Referring to FIG. 26, vibrators may be added to the vacuum hose end to loosen hard to vacuum materials such as dry chemicals or elements in cyclones, storage bends, or railcars. Metal may be cleaned and prepared for welding or painting by water pressure. Adding lubricants to the water helps reduce the rust causing effect of using water pressure to remove scale, rust, primers, or paint from metals. Abrasive elements may also be added to the pressurized water to aid in loosing scale, rust, primers, or paint from metal. Once the pressure water loosens the above, the vacuum system described above vacuums the liquid and debris from the steel surface. Heated air under pressure may be blown onto the steel after vacuuming so as to remove remaining water residue. The vacuum/blower unit can double as both the source of vacuum and the source of heated air, since the vacuum producing means heats the air vacuumed from the vacuum container before the air is exhausted. The above described water pressure nozzle jet and vacuum system function as an alternative to using sand blasting as a means to clean and prep metal and clean welds.

Referring to FIGS. 27*a* and 27*b*, the air entering into or discharged from the combination blower/vacuum producing device may be passed through a muffler to reduce audible sounds conveyed by the blower air. The muffler of choice consists of passing the air through a perforated conduit wrapped with serwool or mineral wool or acoustic absorbing media. A protective outer surface is attached to contain and protect. The acoustic sound waves are absorbed into the wool or acoustic media For yet further sound reduction the air may then be diffused through additional tubes and orifices.

Figure 28:
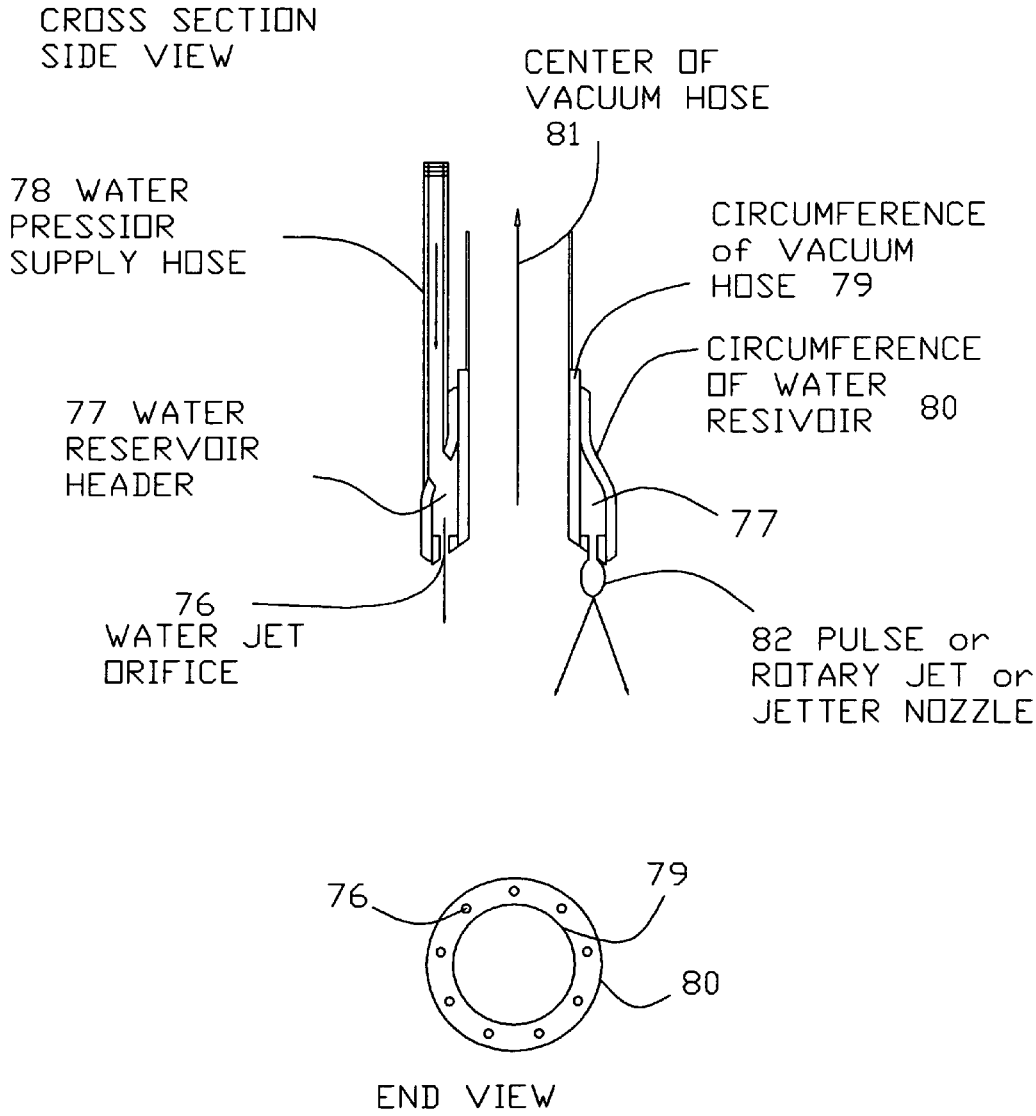
FIG. 28 is a cross sectional side view of a vacuum hose end according to an embodiment of the invention.

FIG. 28 is a means of using a water header (78) as the outer circumference (80) of the suction end of a vacuum hose (17). The water header (78) is supplied by a water supply hose (5), which may be placed in parallel proximity to the vacuum hose (17) and may be articulated by the same vacuum boom. The vacuum hose (17) suction end circumference water header (77) may have two or more orifices (76) and/or spray nozzles (82) to distance the water under pressure. A pulsing jet of water is preferred in many applications. A rotary spray nozzle, jetter nozzle, or air or water pulsing means (82) often reduces water consumption and simultaneously improves mass impact for loosening or emulsifying items to be vacuumed. A preferred arrangement is to have a vacuum hose (17) and circumference (80) configured as a water reservoir (77) to supply water to two or more pulse spray nozzles or jetter nozzles (82) arranged as the circumference (80) of the vacuum hose (17) suction end. The circumference (80) water reservoir is supplied by a pressure water hose (5) or conduit, a water pump, pressure regulation, controller, and sensors incorporated within the system.

While particular embodiments of the invention have been shown, it will be understood, of course, that the invention is not limited thereto since modifications may be made by those skilled in the art, particularly in light of the foregoing teachings. Reasonable variation and modification are possible within the scope of the foregoing disclosure of the invention without departing from the spirit of the invention.

Definition

1—Dispensing means

2—Liquid

3—Liquid Discharge conduit from Hydro cyclone 25
4—Solids Discharge conduit from Hydro cyclone 25
5—Discharge conduit from Liquid transfer pump 7
6—Solids
7—Liquid Transfer pump
8—Container to hold dispensed liquids
9—Container to hold dispensed solids
10—Solids dispenser
11—Vacuum producing means
12—Vacuum container
13—Conduit to connect Vacuum container 12—vacuum producing means 11
14—Discharge conduit from Vacuum producing means 11
15—Utility
16—Inlet conduit to Hydro cyclone 25
17—Vacuum conduit
18—End door to Vacuum container 12
19—Means to secure end door 18
20—Hinge for End door 18
21—Screen
22—Spring on Screen 21
23—Vibrator
24—Support for Springs 22
25—Hydro cyclone
26—Liquid sprayer
27—Grinder
28—Pivot support for Vacuum container 12
29—Cylinder to Raise and Lower Vacuum Container 12
30—Wheels on Mobile Platform 31
31—Mobile Platform
32—Cutting, Demolition, Cleaning and Blasting attachment means
33—Utility Sensor means
34—Monitor and/or Controller
35—Ground Surface being dirt, asphalt, stone, or concrete
36—Means to Mobilize Vacuum conduit 17 with attachment 32
37—Hose Reel
38—Drain Conduit
39—Jetter
40—Water Jet
41—Means to power the Articulating Vacuum Boom
42—Telescoping Vacuum conduit
43—Digging Bucket
44—Structural Means to Support and Articulate Vacuum Conduit
45—Debris
46—Man Hole Cover
47—Means to Remove Man Hole Cover such as Electric Magnet, suction, mechanical fastener
48—Power to Man Hole Cover removal means 47
49—Solids Conveyer
50—Boom Section
51—Vacuum conduit Tractor
52—Vacuum conduit Tractor Sensor Controller
53—Vacuum conduit Tractor Articulating Suction Head
54—Vacuum Hose Reel
55—Purification Elements such as ozone, activated carbon or zealite
56—Hydro carbon Absorbing means
57—Sterilization means
58—Jetter Hose
59—Man Hole
60—Articulating Jetter Boom
61—Telescoping Jetter Conduit
62—Filter Housing
63—Goose Neck Trailer Coupler
64—Skid and Lifting Receiver
65—Fill Pipe to Water Tank
66—Inside Debris Tank Center Door Closure Means
67—Power Plant
68—Flexible Connector for Vibrated Screen
69—Air Nozzle Orifice to blow and convey solids and convey solids by air through the Boom Conduit
70—Solids dispensing, telescoping and Articulating Boom
71—Air Discharge from Vacuum Blower
72—Combination Vacuum Hose and Jetter Water Hose articulated Telescoping Boom
73—Swivel articulated Knuckle Joint to align Jetter and/or Vacuum Hose into a lateral line.
74—Recycled Water Purification and Sterilization System
75—Independent Hydraulic Drive Wheels
76—Water Jet Orifice
77—Water Reservoir Header
78—Water Pressure
79—Circumference of Vacuum Hose
80—Circumference of Water Reservoir
81—Center of Vacuum Hose
82—Pulse or Rotary Jet or Jetter Nozzle
83—Hydraulic Power Supply
84—Hydraulic Tool and Equipment connection
85—Hydraulic driven motor or Electric driven motor
86—Articulating Boom Arm
87—Control system for Drive Motor
88—Revolution and/or Torque counter for Drive Motor
89—.
90—GPS (Global Positioning System) to map location of drive motor operation such as the location of a valve to be opened or closed or a core sample to be taken or a man hole location or repair point location or bored hole location
91—Adapters for the drive motor such as extensions to reach and connect to valve stems or augers.
92—Valve with valve stem
93—Hose
94—Hydrant
95—Water pressure reducer-diffuser
96—Hose Storage
97—Liquid such as water from a hydrant
98—In ground casing to valve stem
99—Bafflers to absorb energy and reduce water pressure
100—Hitch receiver
101—Hitch receiver plugin
102—Hitch stabilizing means
103—Vehicle plug in power supply
104—Power supply for drive motor

What is claimed:

1. A mobile vacuum excavation method comprising the steps of: providing a vacuum container, said vacuum container having a length and width, and having a vacuum producing means to create a vacuum environment within said vacuum container, providing a conduit to vacuum liquid or solid particles into said vacuum container, and said vacuum container being fixedly mounted on said mobile vacuum excavation means at an inclined slope along said length of said vacuum container and said incline slope being sufficient to allow said solids or liquid to dispense from said vacuum container by gravity through an access door to said vacuum container when said access door is opened along said width of said vacuum container, and further providing a liquid storage container, and said liquid storage container being adjacently mounted below said incline slope of said vacuum container and wherein said liquid storage container comprises an additional step of having said liquid storage container side walls add structural support to said vacuum container, and further comprising the steps of: providing a filter housing means having a length and width, and said length of said filter housing being mounted on an incline slope adjacent to said length of said vacuum container, and said vacuum container adding structural support to said filter housing.

2. A mobile vacuum excavation method according to claim 1, wherein said liquid storage container further comprises the step of having a liquid stored within said liquid storage container, and further comprising the step of a liquid pump means, a liquid conduit means and a nozzle means being mounted to said mobile vacuum excavation means, and further comprising the step of said liquid being pressurized by said liquid pump, flowed through said liquid conduit and nozzle means to impinge an earthen material in order to improve the vacuum ability of said earthen material.

3. A vacuum excavation method according to claim 1, wherein said vacuum container and said liquid storage container comprise an additional step of mounting auxiliary equipment adjacent to said vacuum container, or said liquid storage container, and said auxiliary equipment being chosen from a group consisting of one or more of a vacuum blower exhaust muffler, a vacuum pump, a power plant, a hydraulic reservoir, a hydraulic pump, a vacuum pump, an air filter, a water pump, a boom arm, a trailer, an engine, a hose reel, a jetter, a hydraulic connection for hydraulic tools, a hydraulic tool, an air compressor, a generator, a process controller, a surface cleaning tool, a jack hammer, a concrete saw, a solids liquid separator, a water filter, a water heater, a water purifier, a water sterilizer, a vibrating screen, a liquid recycling system, a hydrocarbon absorption system, a solids dispensing system, an air conveyor, a screw conveyor, a cyclone, a liquid dispensing system, a vibrator, an excavation bucket, a torque wrench, a hydro-cyclone, a noise muffler, a goose neck trailer coupler, a skid steer, a zero turn radius vehicle, a rail road car, a fork lift, a truck, a back hoe, a track loader, a barge, a powered linear actuator or telescoping cylinder to open or close an access door to said vacuum container, a skid mounting base, and a fuel reservoir.

4. A vacuum excavation method according to claim 1 wherein said vacuum container comprises an additional step of providing a vibrating screen disposed within said vacuum container to separate liquids from solids.

5. A vacuum excavation method according to claim 1 wherein said vacuum container comprises an additional step of providing a means to dispense a liquid from said vacuum container without eliminating the vacuum environment within said vacuum container, and said dispensing means being chosen from a group consisting of a pump, a grinder, and a progressive cavity screw.

6. A mobile vacuum excavating method comprising the steps of: providing a vacuum container, said vacuum container having a length and width, and said vacuum container having a vacuum producing means to create a vacuum environment within said vacuum container, providing a conduit to vacuum liquid or solid particles into said vacuum container, and said vacuum container being fixedly mounted on said mobile vacuum excavating means at an inclined slope along said length of said vacuum container and said incline slope being sufficient to allow said solids or liquid to dispense from said vacuum container by gravity through an access door along said width of said vacuum container when said access door is opened, and further providing a liquid storage container, and said liquid storage container being adjacently mounted below said incline slope of said vacuum container and wherein said liquid storage container comprises an additional step of having said liquid storage container side walls add structural support to said vacuum container, and further comprising the steps of: providing a filter housing means having a length and width to house air filters, said length of said filter housing being mounted on an incline slope adjacent to said length of said vacuum container, and said vacuum container adding structural support to said filter housing, and said width of said filter housing being mounted adjacent to said width of said vacuum container so as to allow a single door access to both said filter housing and said vacuum container, and said filter housing having a connecting conduit to flow air from said vacuum container to said filter housing and said filter housing having filters disposed within it to remove solids from said air.

7. A vacuum excavation method according to claim 6 wherein said vacuum container comprises an additional step providing an access door that is opened and closed by a telescoping means disposed within said vacuum container, and said telescoping means being chosen from one or more devices selected from a group consisting of a hydraulic cylinder, an air cylinder and a linear actuator.

8. A mobile vacuum excavation method comprising the steps of: providing a vacuum container having a length and width and, a filter housing, and a liquid storage container, said vacuum container comprising a vacuum producing means to create a vacuum environment within said vacuum container, and further comprising a conduit to vacuum solid particles or liquid into said vacuum container, and said vacuum container being fixedly mounted on said mobile vacuum excavation means at an inclined slope along said length of said container and said incline slope being sufficient to allow said solids or said liquid to be dispensed from said vacuum container by gravity through an access door of said vacuum container when said access door is opened along said width of said vacuum container, and further comprising the step of said liquid storage container being adjacently mounted below said incline slope of said vacuum container and further comprising the step of said filter housing being mounted on an incline slope adjacent to said vacuum container, and further comprising an articulated boom arm mounted on said mobile vacuum excavation means and said articulated boom arm having one or more arms.

9. A vacuum excavation method according to claim 8, wherein said articulated boom arm comprise an additional step of mounting or supporting one or more conduits adjacent to said boom arm, and said conduits being chosen from a group consisting of a vacuum conduit, a water conduit, a hydraulic conduit, or an air conduit.

10. A vacuum excavation method according to claim 1, or 6, wherein said vacuum container, said liquid storage container or said filter housing comprise an additional step of mounting an articulated boom arm adjacent to said vacuum container, liquid storage container or filter housing and said articulated boom arm having one or more boom arms, and one or more elbows and said articulated boom arm comprises an additional step of having auxiliary equipment mounted adjacent to said boom arm and said auxiliary equipment being chosen from a group consisting of a linear actuator, a hydraulic cylinder, a remotely controlled operating system, a control system, a control system monitor, a jetter, a sand blaster, a telescoping boom arm, a telescoping vacuum conduit, a powered rotating knuckle, a sand blasting tool, a vibrator, a concrete saw, a jack hammer, a vacuum hose with vacuum hose end attachments, a water pressure hose with spray nozzle attachments, an air hose with air tool attachments, an electric cord with attachments for electric power tools, hydraulic hoses with hydraulic tool attachments, an excavation bucket, a surface cleaner, a grinder, a pump, a torque wrench, a sensor to detect buried utilities, and a man hole cover removal tool.

11. A vacuum excavation method according to claim 1 or 8 wherein said vacuum container comprises an additional step of providing a vibrating screen disposed within said vacuum container to separate liquid from solids and said vacuum container further comprises an additional step of providing a means to dispense a liquid from said vacuum container without eliminating the vacuum environment within said vacuum container, and said dispensing means being chosen from a group consisting of a pump, a grinder, and a progressive cavity screw and an additional step providing a means to recycle said liquid to a surface cleaning means having one or more devices selected from the group consisting of a liquid pressure spray nozzle, a means to direct said liquid to impinge said surface to be cleaned with said liquid, a housing to contain said liquid spray, a vacuum conduit attachment to said housing, a vacuum conduit to vacuum said sprayed liquid from said surface, and said vacuum conduit being used to convey said surface cleaning liquid to said vacuum container.

* * * * *